US005953934A

United States Patent [19]

Makino et al.

[11] Patent Number: 5,953,934

[45] Date of Patent: Sep. 21, 1999

[54] REFRIGERANT CIRCULATING APPARATUS AND METHOD OF ASSEMBLING A REFRIGERANT CIRCUIT

[75] Inventors: Hiroaki Makino; Takeshi Izawa; Yasushi Akahori; Yoshinori Shirafuji; Koji Yamashita, all of Tokyo, Japan

[73] Assignee: Mitsubishi Denki Kabushiki Kaisha, Tokyo, Japan

[21] Appl. No.: 09/002,395

[22] Filed: Jan. 2, 1998

[30] Foreign Application Priority Data

| | | | |
|---|---|---|---|
| Jan. 6, 1997 | [JP] | Japan | 9-000168 |
| Jan. 20, 1997 | [JP] | Japan | 9-007837 |
| Nov. 11, 1997 | [JP] | Japan | 9-308448 |
| Nov. 11, 1997 | [JP] | Japan | 9-308449 |

[51] Int. Cl.[6] ..... F25B 43/02; F25B 39/04

[52] U.S. Cl. ..... 62/470; 62/84; 62/192; 62/509

[58] Field of Search ..... 62/84, 149, 192, 62/193, 324.4, 324.6, 468, 470, 471, 473, 509, 512

[56] References Cited

U.S. PATENT DOCUMENTS

| | | | |
|---|---|---|---|
| 1,956,198 | 7/1934 | Maccabee | 230/206 |
| 3,232,073 | 2/1966 | Jobes et al. | 62/471 |
| 3,301,002 | 1/1967 | McGrath . | |
| 5,452,585 | 9/1995 | Pincus et al. | 62/84 |
| 5,517,824 | 5/1996 | Konishi et al. | 62/84 |
| 5,531,080 | 7/1996 | Hirahara et al. | 62/470 |
| 5,542,266 | 8/1996 | Suzuki et al. | 62/469 |
| 5,634,345 | 6/1997 | Alsenz | 62/84 |

FOREIGN PATENT DOCUMENTS

| | | |
|---|---|---|
| 2 3 08 481 | 8/1973 | Germany . |
| 34 33 915 | 5/1985 | Germany . |
| 64-19253 | 1/1989 | Japan . |
| 7-208819 | 8/1995 | Japan . |
| 146 359 | 7/1993 | Switzerland . |

*Primary Examiner*—William Doerrler

*Attorney, Agent, or Firm*—Oblon, Spivak, McClelland, Maier & Neustadt, P.C.

[57] ABSTRACT

In a refrigerant circulating apparatus, a liquid accumulating container for allowing oil droplets to flow out in suspended form is connected between a condenser and a pressure reducing device. Thus, refrigerating machine oil which flowed out from a compressor can be reliably returned to the compressor, and proper lubricating and sealing functions can be maintained for the compressing elements.

25 Claims, 17 Drawing Sheets

REFRIGERANT CIRCULATING APPARATUS AND METHOD OF ASSEMBLING A REFRIGERANT CIRCUIT

BACKGROUND OF THE INVENTION

The present invention relates to a refrigerant circulating apparatus having a refrigerant circuit in which a refrigerating machine oil is difficult to dissolve in a refrigerant as in a case where, for example, a hydrofluorocarbon- (HFC-) based refrigerant is used as a refrigerant and an alkylbenzene-based oil as a refrigerating machine oil.

An example of a conventional refrigeration and air-conditioning cycle apparatus is shown in FIG. 20. In a case where a refrigerating machine oil such as alkylbenzene, which has weak compatibility with respect to a hydrofluorocarbon- (HFC-) based refrigerant, is used as shown in Japanese Patent Application Laid-Open No. 208819/1995, the return of oil from an accumulator provided on the low-pressure side where the solubility of the refrigerating machine oil in the liquid refrigerant declines has hitherto been an important problem in the reliability of a compressor. FIG. 20 shows a refrigeration and air-conditioning cycle apparatus in which an HFC-based refrigerant and an oil having weak solubility are used as a refrigerant and a refrigerating machine oil, respectively, wherein reference numeral 1 denotes a compressor for compressing a refrigerant gas; 2, a four-way valve having the function of reversing the flowing direction of the refrigerant; 5, a pressure reducing device; 7, an accumulator for accumulating surplus refrigerant; 14, a refrigerating machine oil stored in the compressor 1 to effect the lubrication of sliding portions of the compressor 1 and the sealing of a compression chamber; 52, a condenser for condensing a high-pressure refrigerant gas discharged from the compressor 1; and 55, an evaporator.

The refrigerating machine oil with weak solubility used in this refrigeration and air-conditioning cycle apparatus, e.g., alkylbenzene, has nonsolubility or very weak solubility with respect to an HFC-based refrigerant, with its rate of solubility in the liquid refrigerant under the conditions of condensing pressure and condensing temperature being 0.5–7 wt %, its rate of solubility in the liquid refrigerant under the conditions of evaporating pressure and evaporating temperature being 0–2.0 wt %, and its specific weight in the temperature range of −20° C. to +60° C. being a value smaller than the specific weight of the liquid refrigerant at the same temperature and under saturated vapor pressure.

Next, a description will be given of the behavior of the refrigerating machine oil. The high-pressure refrigerant gas compressed by the compressor 1 is discharged to the condenser 52. Most of the refrigerating machine oil 14 used for lubricating the compressor and for sealing the compression chamber returns to the bottom of a hermetic container, but the refrigerating machine oil having an oil circulation rate of 0.3 to 2.0 wt % or thereabouts is discharged together with the refrigerant from the compressor 1. The pipe diameter of the condenser 52 where the refrigerant gas flows is set so as to secure a flow rate of the refrigerant gas sufficient to convey the refrigerating machine oil downstream. Although most of the refrigerant liquefies in the vicinity of an outlet of the condenser 52 and the in-pipe flow rate declines appreciably, since the refrigerating machine oil has weak solubility with respect to the condensed liquid refrigerant, the refrigerating machine oil dissolves in the liquid refrigerant and is conveyed to the pressure reducing device 5. The temperature and pressure of the refrigerant decline appreciably in a region downstream of the pressure reducing device 5, and the solubility characteristic of the refrigerating machine oil changes to nonsolubility or very weak solubility with respect to the liquid refrigerant. However, the refrigerating machine oil is conveyed to the accumulator 7 since the flow rate of the refrigerant increases abruptly due to the gasification of part of the liquid refrigerant which occurs in the region downstream of the pressure reducing device 5, and since the pipe diameter of the evaporator 55 in the next stage is set so as to secure a flow rate of the refrigerant gas sufficient to convey the refrigerating machine oil downstream. Since the solubility of the refrigerating machine oil in the liquid refrigerant under the conditions of evaporating pressure and evaporating temperature is nil or very weak, the refrigerating machine oil 81 forms a separate layer over the liquid refrigerant 13 inside the accumulator 7. For this reason, the structure provided is such that a plurality of oil returning holes 72*a*, 72*b*, 72*c*, and 72*d* having different heights from a lower end 7*a* of the accumulator are provided in a lead-out pipe 71 for leading the refrigerant from inside to outside the accumulator, thereby promoting the return of the oil to the compressor 1.

As another example of the conventional refrigeration and air-conditioning cycle apparatus, a refrigeration and air-conditioning cycle apparatus disclosed in Japanese Patent Application Laid-Open No. 19253/1989 is shown in FIG. 21. Reference numeral 1 denotes the compressor for compressing a refrigerant gas; 52, the condenser for condensing the high-pressure refrigerant gas discharged from the compressor 1; 31, a pre-stage pressure reducing device; 54, a receiver for accumulating surplus refrigerant; 32, a post-stage pressure reducing device; 55, the evaporator; and 2, the four-way valve having the function of reversing the flowing direction of the refrigerant.

Next, a description will be given of the operation of this refrigeration and air-conditioning cycle apparatus. The high-pressure refrigerant gas compressed by the compressor 1 passes through the condenser 52 while becoming liquefied, is then subjected to pressure reduction by the pre-stage pressure reducing device 31, and enters the receiver 54. Here, by controlling the pressure reducing devices disposed respectively before and after the receiver 54, the surplus refrigerant is accumulated in correspondence with the condition of the load of the apparatus, thereby optimizing the performance and efficiency and ensuring the reliability of the compressor. The liquid refrigerant which flowed out from the receiver 54 is further subjected to pressure reduction to the level of necessary evaporating pressure, then passes through the evaporator 55, and is sucked into the compressor 1.

In the refrigeration and air-conditioning cycle apparatus shown in FIG. 20 and cited as a conventional example which uses a hydrofluorocarbon- (HFC-) based refrigerant as a refrigerant and an alkylbenzene-based oil as a refrigerating machine oil, the following problem is encountered in the case where a large amount of surplus refrigerant is accumulated in the accumulator 7 and the liquid level has become high.

First, although the refrigerating machine oil 81 which cannot be dissolved in the liquid refrigerant is separated from the liquid refrigerant 13 and is accumulated in an upper layer of the two separated layers, since the force of suction from the upper holes 72*c* and 72*d* declines as compared with that from the hole 72*a* provided in a lower end of the lead-out pipe 71 among the oil holes 72 provided in the lead-out pipe 71 inside the accumulator 7, only the liquid refrigerant 13 in the lower layer flows into the lead-out pipe 71, and the refrigerating machine oil 81 in the upper layer scarcely flows into the lead-out pipe 71. Therefore, the refrigerating machine oil 81 is accumulated in a large amount inside the accumulator 7, with the result that the refrigerating machine oil 81 in the compressor 1 is depleted, possibly causing faulty lubrication. Next, when the liquid level of the liquid refrigerant becomes high, since the liquid refrigerant is sucked from the plurality of oil returning holes in the lead-out pipe 71, a large amount of liquid refrigerant returns to the compressor 1, which possibly results in a sudden pressure rise in the compression chamber due to the supply of the noncompressive liquid refrigerant to the interior of the compression chamber. In addition, since the liquid refrigerant discharged from the compression chamber is detained in the hermetic container of the compressor, the liquid refrigerant instead of the refrigerating machine oil 81 is supplied to lubricating element portions, which can cause seizure and the like of the bearing of the compressor 1 and sliding portions of compressing elements, thereby leading to a decline in the reliability. In addition, if the diameters of the oil returning holes 72 are set to be small so as to prevent a large amount of liquid refrigerant from returning to the compressor 1, the return of the refrigerating machine oil 81 is further aggravated, and dust, impurities, and the like in the circuit are liable to clog the oil returning holes 72.

With the refrigeration and air-conditioning cycle apparatus shown in FIG. 21 and cited as a conventional example, the apparatus can be operated without a problem in a case where a refrigerating machine oil having compatibility with a refrigerant is used, but if a refrigerating machine oil having noncompatibility or weak compatibility is used, the refrigerating machine oil which is nonsoluble in the liquid refrigerant is separated in an upper layer and is detained inside the receiver 54 under the operating conditions in which the rate of oil circulation is large, and the refrigerating machine oil inside the compressor 1 is depleted, thereby possibly causing faulty lubrication.

Conventionally, when an airtight test is performed in the process of manufacturing the compressor using R.22 as a refrigerant, a discharge pipe and a suction pipe are closed by jigs, and the airtight test is performed under the pressure of 28 kgf/cm$^2$G. However, in a case where a high-pressure refrigerant such as R.410A is used as the hydrofluorocarbon-(HFC-) based refrigerant, the pressure corresponding to the refrigerant in the case of R.410A is considerably high at 45 kgf/cm$^2$G, with the result that there has been a possibility of the jigs from coming off when the airtight test is performed.

SUMMARY OF THE INVENTION

The present invention has been devised to overcome the above-described problems, and its object is to provide a highly reliable refrigerating and air-conditioning apparatus which is capable of reliably returning the refrigerating machine oil even in a case where a refrigerant circuit is provided in which the refrigerant and the refrigerating machine oil are difficult to dissolve, and which is capable of accumulating the surplus liquid refrigerant so that a large amount of liquid refrigerant will not return to the compressor. Another object of the present invention is to obtain an apparatus which is inexpensive and highly reliable with a simple arrangement.

In accordance with the present invention, the refrigerant circulating apparatus having a refrigerant circuit in which a compressor, a condenser, a pressure reducing device, and an evaporator are consecutively connected by refrigerant pipes, the refrigerant circulating apparatus comprises: a liquid accumulating container connected between the condenser and the pressure reducing device for allowing oil droplets to flow out in suspended form, by using a refrigerating machine oil which exhibits nonsolubility or very weak solubility in terms of a rate by weight of solubility of the refrigerating machine oil in a liquid refrigerant under conditions of condensing pressure and condensing temperature and which exhibits nonsolubility or very weak solubility in terms of a rate by weight of solubility of the refrigerating machine oil in the liquid refrigerant under conditions of evaporating pressure and evaporating temperature, and which has smaller specific gravity than the refrigerant.

The refrigerant circulating apparatus in accordance with the present invention further comprises: means for changing over a flowing direction of the refrigerant, the liquid accumulating container for allowing the oil droplets to flow out in suspended form being connected between the condenser and the pressure reducing device on a flowing side where the refrigerant becomes surplus.

In accordance with the present invention, in the refrigerant circulating apparatus having a refrigerant circuit in which a compressor, means for changing over a flowing direction of a refrigerant, a condenser, a pair of pressure reducing devices, and an evaporator are consecutively connected by refrigerant pipes, the refrigerant circulating apparatus comprises: a liquid accumulating container interposed between the pressure reducing devices, by using a refrigerating machine oil which exhibits nonsolubility or very weak solubility in terms of a rate by weight of solubility of the refrigerating machine oil in a liquid refrigerant under the conditions of condensing pressure and condensing temperature and which exhibits nonsolubility or very weak solubility in terms of a rate by weight of solubility of the refrigerating machine oil in the liquid refrigerant under the conditions of evaporating pressure and evaporating temperature.

In the refrigerant circulating apparatus in accordance with the present invention, refrigerant pipes at an inlet and an outlet of the refrigerant into and from the liquid accumulating container are inserted into the container from a lower portion thereof, and the refrigerant inside the liquid accumulating container is allowed to flow from below to above and is agitated.

In the refrigerant circulating apparatus in accordance with the present invention, the refrigerant inside the liquid accumulating container is agitated by changing a state of a phase of the refrigerant or a state of pressure thereof at a position where the refrigerant flows in from an inlet pipe of the liquid accumulating container for accumulating surplus refrigerant.

The refrigerant circulating apparatus in accordance with the present invention further comprises: at least one of subcooling detecting means for detecting a subcooling characteristic value corresponding to a degree of subcooling of the refrigerant at an outlet of the condenser and superheating detecting means for detecting a superheating characteristic value corresponding to a degree of superheating of the refrigerant sucked into the compressor; calculating means for calculating a deviation with a targeted value corresponding with at least one of a result of detection by the superheating detecting means and a result of detection by the subcooling detecting means; and controlling means for controlling a control valve of at least one of the pressure reducing devices on a high-pressure side and a low-pressure side on the basis of the result of calculation by the calculating means.

In the refrigerant circulating apparatus in accordance with the present invention, a control valve which is controllable is used as the pressure reducing device, and an area of an opening in the control valve is controlled such that the liquid refrigerant in the container becomes temporarily empty.

In the refrigerant circulating apparatus in accordance with the present invention, the control valve which is controllable is used as the pressure reducing device, and the control valve is controlled with the lapse of a predetermined time after starting.

The refrigerant circulating apparatus in accordance with the present invention comprises: a refrigerant circuit in which a compressor, a condenser, a pair of pressure reducing devices, and an evaporator are consecutively connected by refrigerant pipes; a liquid accumulating container provided in the refrigerant circuit for accumulating a refrigerant and a refrigerating machine oil which exhibits nonsolubility or very weak solubility in a liquid refrigerant under conditions of condensing pressure and condensing temperature and under conditions of evaporating pressure and evaporating temperature with respect to the refrigerant which circulates in the refrigerant circuit; and oil-solubility-rate setting means for setting at least one of the temperature and pressure of the refrigerant in the liquid accumulating container such that a rate of solubility of the refrigerating machine oil in the liquid refrigerant inside the liquid accumulating container becomes approximately equivalent to or higher than an oil circulation rate of the refrigerating machine oil which flows out from the compressor to the refrigerant circuit during operation.

In the refrigerant circulating apparatus in accordance with the present invention, pressure reducing devices are respectively disposed before and after the liquid accumulating container disposed in the refrigerant circuit for accumulating the refrigerant, and the temperature and pressure of the refrigerant in the liquid accumulating container are set by the pressure reducing devices such that the rate of solubility of the refrigerating machine oil in the liquid refrigerant inside the liquid accumulating container becomes approximately equivalent to or higher than the oil circulation rate of the refrigerating machine oil which flows out from the compressor to the refrigerant circuit during operation.

In the refrigerant circulating apparatus in accordance with the present invention, means for making oil droplets finer is used as at least a pre-stage pressure reducing device of the pressure reducing devices disposed respectively before and after the liquid accumulating container.

The refrigerant circulating apparatus in accordance with the present invention comprises: a refrigerant circuit in which a compressor, a condenser, a pressure reducing device, and an evaporator are consecutively connected by refrigerant pipes; a liquid accumulating container provided in the refrigerant circuit for accumulating a refrigerant and a refrigerating machine oil which exhibits nonsolubility or very weak solubility in a liquid refrigerant under conditions of condensing pressure and condensing temperature and under conditions of evaporating pressure and evaporating temperature with respect to the refrigerant which circulates in the refrigerant circuit; and oil recovering means disposed in an interior of the compressor or on a discharge side of the compressor for lowering an oil circulation rate such that the oil circulation rate of the refrigerating machine oil which flows out from the compressor to the refrigerant circuit during operation becomes approximately equivalent to or lower than a rate at which the liquid refrigerant inside the liquid accumulating container dissolves the refrigerating machine oil.

In the refrigerant circulating apparatus in accordance with the present invention, an inlet pipe for the refrigerant to flow into the liquid accumulating container from the refrigerant circuit and an outlet pipe for the refrigerant to flow out from the liquid accumulating container to the refrigerant circuit are arranged with their respective pipe openings disposed in a lower portion of the liquid accumulating container, and are arranged to allow the refrigerant to flow directly from the inlet pipe into the outlet pipe.

The refrigerant circulating apparatus in accordance with the present invention further comprises: an engaging portion disposed on a discharge-side pipe of the compressor and having a changed outside diameter of the pipe.

In the refrigerant circulating apparatus in accordance with the present invention, the refrigerating machine oil has nonsolubility or very weak solubility with respect to the refrigerant, with its rate by weight of solubility in the liquid refrigerant under the conditions of condensing pressure and condensing temperature being 0.5–7 wt %, and its rate by weight of solubility in the liquid refrigerant under the conditions of evaporating pressure and evaporating temperature being 0–2.0 wt %.

The method of assembling a refrigerant circuit in accordance with the present invention comprises the steps of: providing in the refrigerant circuit liquid accumulating means for accumulating a refrigerant circulating in a refrigerant circuit in which a compressor, a condenser, a pressure reducing device, and an evaporator are consecutively connected by refrigerant pipes; sealing in the refrigerant circuit a refrigerating machine oil which exhibits nonsolubility or very weak solubility in a liquid refrigerant under conditions of condensing pressure and condensing temperature and under conditions of evaporating pressure and evaporating temperature; and setting at least one of the temperature and pressure of the refrigerant in the liquid accumulating means such that a rate of solubility of the refrigerating machine oil in the liquid refrigerant inside the liquid accumulating means becomes approximately equivalent to or higher than an oil circulation rate of the refrigerating machine oil which flows out from the compressor to the refrigerant circuit during operation.

The method of assembling a refrigerant circuit in accordance with the present invention comprises the steps of: changing a kind of refrigerant to be circulated in a refrigerant circuit in which a compressor, a condenser, a pressure reducing device, an evaporator, and liquid accumulating means for accumulating a refrigerant are consecutively connected by refrigerant pipes from a sealed refrigerant to another refrigerant; continuing to seal in the a refrigerating machine oil sealed in the compressor even if the kind of refrigerant is changed; and setting at least one of the temperature and pressure of the refrigerant in the liquid accumulating means such that a rate of solubility of the refrigerating machine oil in the changed refrigerant becomes approximately equivalent to or higher than an oil circulation rate of the refrigerating machine oil which flows out from the compressor to the refrigerant circuit during operation in a case where the rate of solubility of the refrigerating machine oil is lower than the oil circulation rate.

DETAILED DESCRIPTION OF THE PREFERRED EMBODIMENTS

First Embodiment

Figure 1:
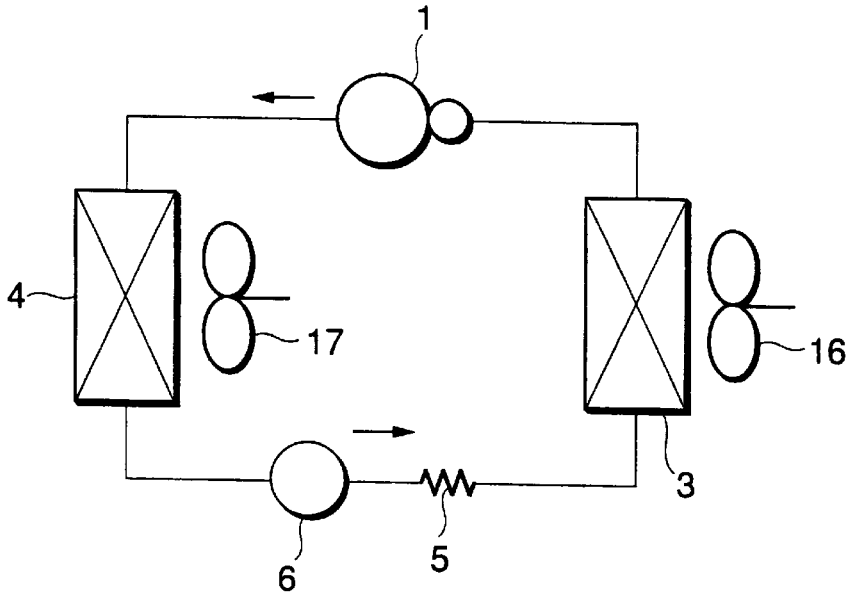
FIG. 1 is a conceptual diagram of a refrigerant circulating apparatus illustrating a first embodiment of the present invention.
Figure 2:
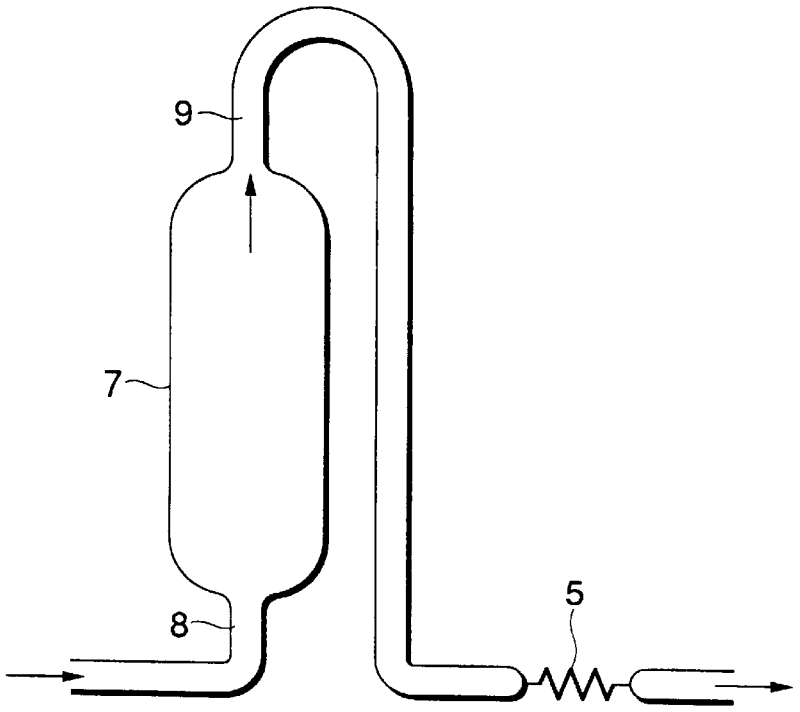
FIG. 2 is a conceptual diagram of a liquid accumulating container illustrating first and second embodiments of the present invention.

Referring now to FIGS. 1 and 2, a description will be given of a first embodiment of the present invention. FIG. 1 shows an example of a refrigerant circulating apparatus which is applied to an air conditioner. In FIG. 1, reference numeral 1 denotes a compressor for compressing a refrigerant gas; 4, an outdoor heat exchanger for condensing the high-pressure refrigerant gas discharged from the compressor 1; 3, an indoor heat exchanger; 5, a pressure reducing device; and 6, a liquid accumulating container for accumulating surplus refrigerant. In addition, FIG. 2 shows the structure of the liquid accumulating container, in which numeral 7 denotes a main body of the liquid accumulating container; 8, an inlet pipe connected to the lower side of the container; and 9, an outlet pipe connected to the upper side of the container. Numerals 16 and 17 denote fans for indoor and outdoor heat exchangers, respectively.

Next, a description will be given of the behavior of the refrigerant and the refrigerating machine oil in a case where the refrigerant flows in the direction of arrows. The high-pressure refrigerant gas compressed by the compressor 1 is discharged together with the refrigerating machine oil having a weight ratio of 2.0% with respect to the refrigerant, and enters the outdoor heat exchanger 4 which is a condenser for condensing the refrigerant. The refrigerating machine oil is conveyed in the outdoor heat exchanger 4 by the refrigerant gas which has a sufficient flow rate. In the vicinity of the outlet port of the outdoor heat exchanger 4, part of the refrigerating machine oil dissolves in the liquefied refrigerant, while the remaining portion of the refrigerating machine oil is transformed into oil droplets, so that the refrigerating machine oil is conveyed to the liquid accumulating container 6 together with the refrigerant. In the main body 7 of the liquid accumulating container where the channel area becomes large, the flow rate of the liquid refrigerant declines, and the refrigerating machine oil which is in the form of oil droplets floats upward in the container since its specific weight is smaller than that of the refrigerant. However, the direction in which the refrigerating machine oil floats upward is the same as the direction of the flow of the refrigerant as indicated by the arrows, and the main body 7 of the container is generally in a state of being filled with the liquid except for a period immediately after starting (for about 5 minutes), so that the refrigerating machine oil is conveyed from the outlet pipe 9 to outside the container without being detained in the main body 7 of the liquid accumulating container. Since part of the liquid refrigerant is gasified by being subjected to pressure reduction to a necessary pressure level by the pressure reducing device 5, the amount of refrigerant which is present in liquid form is reduced, so that the refrigerating machine oil which dissolved in the gasified liquid refrigerant is separated and forms oil droplets. Nevertheless, since the flow rate of the refrigerant increases abruptly due to the gasification of part of the liquid refrigerant, and the pipe diameter of the indoor heat exchanger 3 which is an evaporator in the next stage for evaporating the refrigerant is set so as to secure a flow rate of the refrigerant gas sufficient to convey the refrigerating machine oil downstream, the refrigerating machine oil is conveyed through the indoor heat exchanger and returns to the compressor 1. Thus, the refrigerating machine oil which flowed out from the compressor can be returned reliably to the compressor, and proper lubricating and sealing functions can be maintained for the compressing elements, so that it is possible to obtain an apparatus in which the reliability of the compressor is high. In addition, the structure is simple, productivity and cost performance are outstanding, and a decline in the performance due to the clogging with dust does not occur.

Second Embodiment

Figure 3:
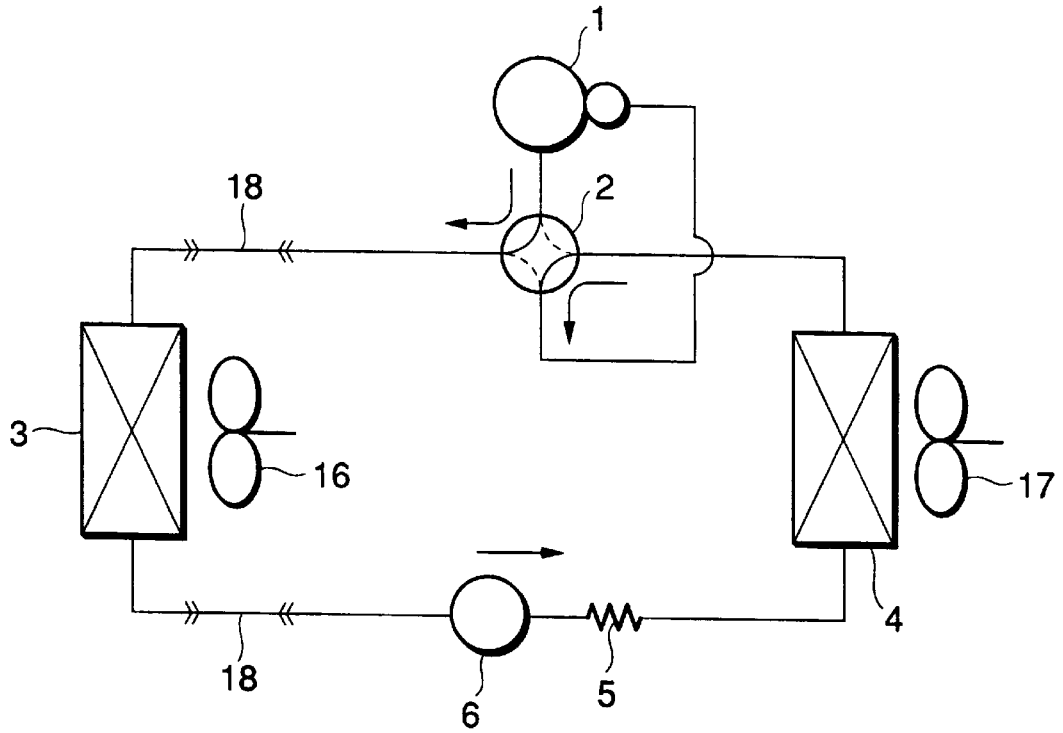
FIG. 3 is a conceptual diagram of the refrigerant circulating apparatus illustrating another embodiment of the present invention.

Referring now to FIGS. 2 and 3, a description will be given of a second embodiment of the present invention. FIG. 3 shows an example of the refrigerant circulating apparatus which is applied to an air conditioner. In FIG. 3, reference numeral 1 denotes the compressor for compressing a refrigerant gas; 2, a four-way valve having the function of reversing the flowing direction of the refrigerant; 18, an extension pipe connecting an indoor unit and an outdoor unit; 3, the indoor heat exchanger; 4, the outdoor heat exchanger; 5, the pressure reducing device; and 6, the liquid accumulating container for accumulating surplus refrigerant. In addition, FIG. 2 shows the structure of the liquid accumulating container, in which numeral 7 denotes the main body of the liquid accumulating container; 8, the inlet pipe connected to the lower side of the container; and 9, the outlet pipe connected to the upper side of the container.

Next, a description will be given of the behavior of the refrigerant and the refrigerating machine oil in a case where heating is effected by the indoor unit. The high-pressure refrigerant gas compressed by the compressor 1 is discharged together with the refrigerating machine oil having a weight ratio of 2.0% with respect to the refrigerant, passes through the four-way valve 2, and enters the indoor heat exchanger 3 which is a condenser. The refrigerating machine oil is conveyed by the refrigerant gas which has a sufficient flow rate, and part of the refrigerating machine oil dissolves in the liquefied liquid refrigerant in the vicinity of the outlet port of the indoor heat exchanger 3, while the remaining portion of the refrigerating machine oil is transformed into oil droplets, so that the refrigerating machine oil is conveyed to the liquid accumulating container 6 together with the refrigerant. In the main body 7 of the liquid accumulating container where the channel area becomes large, the flow rate of the liquid refrigerant declines, and the refrigerating machine oil which is in the form of oil droplets floats upward in the container since its specific weight is smaller than that of the refrigerant. However, the direction in which the refrigerating machine oil floats upward is the same as the direction of the flow of the refrigerant as indicated by the arrows, and the main body 7 of the container is generally in a state of being filled with the liquid except for a period immediately after starting (for about 5 minutes), so that the refrigerating machine oil is conveyed from the outlet pipe 9 to outside the container without being detained in the container. Accordingly, the refrigerating machine oil is conveyed to the pressure reducing device 5 without being detained in the main body 7 of the liquid accumulating container. Since part of the liquid refrigerant is gasified by being subjected to pressure reduction to a necessary pressure level by the pressure reducing device 5, the amount of refrigerant which is present in liquid form is reduced, so that the refrigerating machine oil which dissolved in the gasified liquid refrigerant is separated and forms oil droplets. Nevertheless, since the flow rate of the refrigerant increases abruptly due to the gasification of part of the liquid refrigerant, and the pipe diameter of the outdoor heat exchanger 4 which is an evaporator in the next stage is set so as to secure a flow rate of the refrigerant gas sufficient to convey the refrigerating machine oil downstream, the refrigerating machine oil is conveyed through the outdoor heat exchanger and returns to the compressor 1.

In the case of heating, since the indoor heat exchanger is generally made smaller than the outdoor heat exchanger, the amount of refrigerant can be smaller than in the case of cooling, so that the surplus refrigerant is liable to occur.

On the other hand, in a case where cooling is effected by the indoor unit by allowing the refrigerant to flow reversely by changing over the four-way valve, the roles of condensation and evaporation by the indoor and outdoor heat exchangers are changed over, and the refrigerant, in which part of the refrigerant is gasified due to pressure reduction by the pressure reducing device 5 and the liquid and the gas are mixed, flows from the outlet pipe 9 into the main body 7 of the container. However, since the refrigerant flows from above to below through the container, the refrigerating machine oil is conveyed from the inlet pipe 8 to outside the container without staying therein. For this reason, in the case of cooling in which the refrigerant is used in a large amount, although the liquid accumulating container ceases to function as the liquid accumulating container, there is no need for it, and the refrigerating machine oil which is conveyed together with the refrigerant is conveyed without being detained in the container. Consequently, the refrigerating machine oil discharged from the compressor 1 returns to the compressor 1 without being detained during the cycle.

As described above, since the surplus refrigerant can be accumulated even if the required amount of refrigerant differs due to the flowing direction, it is possible to operate the apparatus efficiently irrespective of the flowing direction. At the same time, the refrigerating machine oil which flowed out from the compressor can be returned reliably to the compressor, and proper lubricating and sealing functions can be maintained for the compressing elements, so that it is possible to obtain an apparatus in which the reliability of the compressor is high.

Third Embodiment

Figure 4:
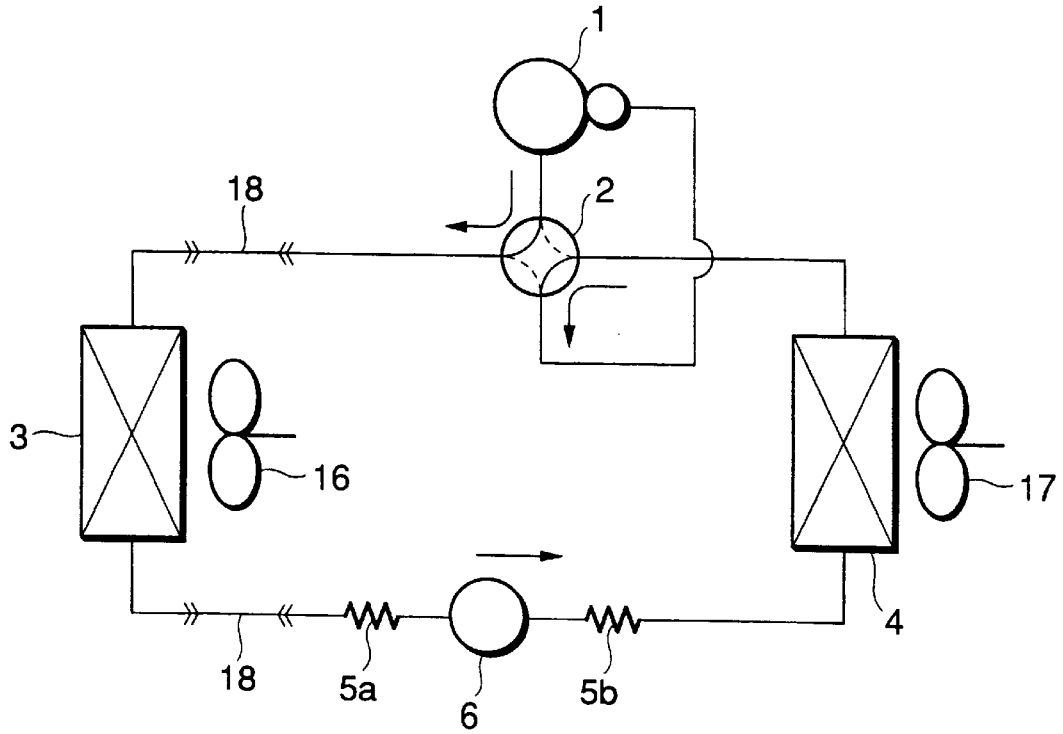
FIG. 4 is a conceptual diagram of the refrigerant circulating apparatus illustrating still another embodiment of the present invention.

Referring now to FIG. 4, a description will be given of a third embodiment of the present invention. FIG. 4 shows an example of the refrigerant circulating apparatus which is applied to an air conditioner. In FIG. 4, reference numeral 1 denotes the compressor for compressing a refrigerant gas; 2, the four-way valve having the function of reversing the flowing direction of the refrigerant; 4, the outdoor heat exchanger; 16, an indoor fan; 3, the indoor heat exchanger; 17, an outdoor fan; 5*a* and 5*b*, the pressure reducing devices; and 6, the liquid accumulating container for accumulating surplus refrigerant.

Next, a description will be given of the behavior of the refrigerant and the refrigerating machine oil. The high-pressure refrigerant gas compressed by the compressor 1 is discharged together with the refrigerating machine oil having a weight ratio of, for example, 1.0% with respect to the refrigerant, passes through the four-way valve 2, and enters the indoor heat exchanger 3 which is a condenser. The refrigerating machine oil is conveyed by the refrigerant gas which has a sufficient flow rate, and the refrigerating machine oil is completely dissolved in the liquefied liquid refrigerant in the vicinity of the outlet port of the indoor heat exchanger 3. Nevertheless, in the case of an alkylbenzene-based oil, the limit of solubility of the refrigerating machine oil in a refrigerant under the conditions of condensing pressure and condensing temperature is 1.5% or thereabouts. The refrigerating machine oil together with the refrigerant passes through the pressure reducing device 5*b*, and is conveyed to the liquid accumulating container 6. Declines in the pressure and temperature in the pressure reducing device 5*a* are set to ranges in which the limit of solubility does not become less than 1%, thereby allowing the refrigerating machine oil to be conveyed to outside the container as it dissolves in the refrigerant without becoming separated from the refrigerant inside the liquid accumulating container 6. Accordingly, the refrigerating machine oil is conveyed to the pressure reducing device 5*b* without being detained in the liquid accumulating container 6. Since the pressure within the pressure reducing device 5*b* is reduced to a necessary pressure level, and the temperature declines abruptly, the limit of solubility of the refrigerating machine oil in the liquid refrigerant declines to 0.5%, with the result that the refrigerating machine oil which cannot be dissolved in the liquid refrigerant is separated and forms oil droplets. Further, in the outdoor heat exchanger 4, most of the refrigerant is gasified, and the amount of refrigerant which is present in liquid form declines, so that the refrigerating machine oil which cannot be dissolved is separated. After the refrigerant leaves the pressure reducing device, however, since the flow rate of the refrigerant due to its gasification assumes a level sufficient to convey the separated refrigerating machine oil downstream, the refrigerating machine oil is conveyed to the compressor 1. In addition, the same also applies to a case where the flowing direction is reversed by the four-way valve 2.

In general, if a liquid pooling section is provided in a refrigerant circuit, and if a refrigerating machine oil is used which is difficult to dissolve in a refrigerant using hydrofluorocarbon, such as a refrigerating machine oil, alkylbenzene, a mineral oil, an ester oil, an ether oil, or the like which has nonsolubility or very weak solubility with respect to, for example, an HFC-based refrigerant, with its rate by weight of solubility in the liquid refrigerant under the conditions of condensing pressure and condensing temperature being 0.5–7 wt %, and its rate by weight of solubility in the liquid refrigerant under the conditions of evaporating pressure and evaporating temperature being 0–0.20 wt %, then the oil which is mixed with the refrigerant is detained inside the container in the refrigerant circuit having the liquid pooling section, i.e., the liquid accumulating container for accumulating the surplus refrigerant, where the moving velocity of the refrigerant becomes slow.

The rate by weight of solubility of the oil in the refrigerant, in the first place, changes depending on the kinds of refrigerant and oil. For instance, in terms of the rate of solubility of refrigerating machine oil alkylbenzene (viscosity grade VG=8–32), i.e., an HAB oil, in the liquid refrigerant R.407C, i.e., an HFC-based refrigerant, as well as the relationship between the oil circulation rate and the compressor frequency, the refrigerating machine oil exhibits a rate of solubility of 1.0–4.0 wt % with respect to the liquid refrigerant in the range of the condensing temperature, but exhibits a very small rate of solubility of 0.2–1.8 wt % with respect to the liquid refrigerant in the range of the evaporating temperature. This rate of solubility changes depending on the combinations of various refrigerants and various oils.

In general, the oil circulation rate, i.e., a weight ratio of the refrigerating machine oil which flows with the refrigerant from the compressor to the refrigerant, assumes a value of 0.3–2.0 wt % or thereabouts, and tends to increase with the rise of the compressor frequency.

The refrigerating machine oil circulates in the refrigerant circuit in an amount which is shown by this oil circulation rate, and is particularly liable to be detained in the liquid accumulating container, and the refrigerating machine oil dissolves in the liquid refrigerant inside the container within the range of its rate of solubility at that temperature. However, in a case where the oil circulation rate has become higher than the rate of solubility of the refrigerating machine oil in the liquid refrigerant under the operating conditions at the location where the refrigerant is present, the amount of the refrigerating machine oil which is circulated exceeds an allowable amount of dissolution in the liquid refrigerant. Consequently, the refrigerating machine oil is separated from the liquid refrigerant, assumes the state of oil droplets or an oil layer in the liquid accumulating container, is detained in the liquid accumulating container, and does not return to the compressor. In contrast, if, for example, the temperature of the liquid refrigerant in the container is detected by a thermistor, and the pressure reducing device 5*a* is set by being moved in the closing direction when the temperature of the refrigerant has become lower than the temperature necessary for the dissolution of the oil, it is possible to dissolve the oil.

It goes without saying that, instead of using electrically-operated expansion valves which are controllable as the pressure reducing devices, settings may be provided from the outset by using capillary tubes so as to suppress the lower limit of the temperature and the lower limit of the pressure within the liquid accumulating container to fixed values under various operating conditions.

Although the foregoing description has been given by citing the HFC-based refrigerant as an example, the present invention is not limited to the same, and it is apparent that similar advantages can be obtained if a refrigerating machine oil which is difficult to dissolve in the refrigerant is used even if an HC-based refrigerant is used.

In a case where the operating frequency of the compressor is low, the condensing temperature declines, and the rate of solubility of the refrigerating machine oil in the refrigerant declines, but since the amount of refrigerating machine oil which is discharged from the compressor also decreases at the same time, so that all the refrigerating machine oil which is circulated can be dissolved in the refrigerant in the liquid accumulating container 6.

As described above, since the surplus refrigerant can be detained in the liquid reservoir in both flowing directions for cooling and heating, the operation can be effected efficiently, and the refrigerating machine oil can be returned to the compressor without being detained in the liquid accumulating container. Hence, it is possible to obtain an apparatus in which the reliability of the compressor is high.

The present invention in accordance with this embodiment is particularly effective for a multi-type air conditioner which has a plurality of indoor units and in which the necessary amount of refrigerant varies substantially depending on the number of the indoor units operated under the respective operating conditions for cooling and heating.

Fourth Embodiment

Figure 5:
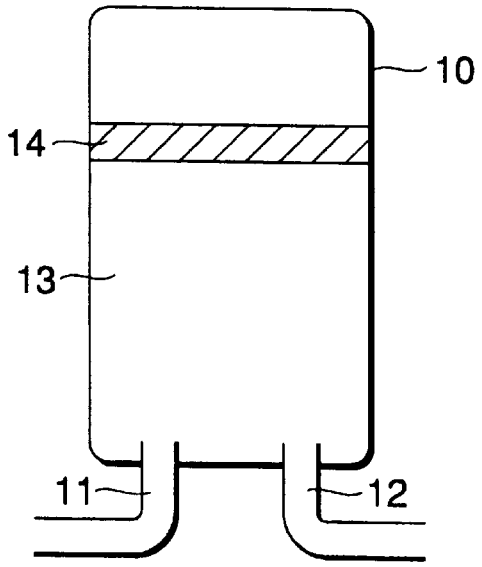
FIG. 5 is a conceptual diagram of the refrigerant circulating apparatus illustrating a further embodiment of the present invention.
Figure 6:
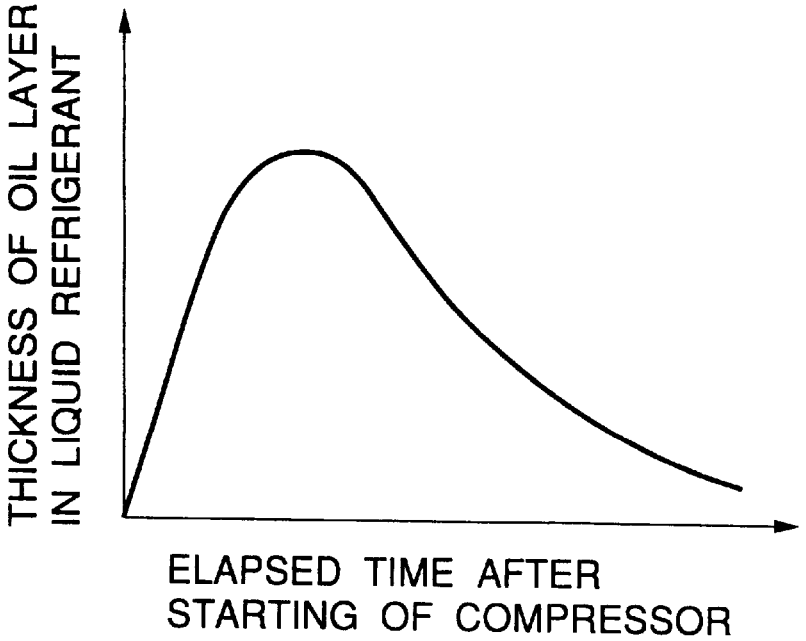
FIG. 6 is a diagram illustrating a change in the detained state of oil in a liquid accumulating container after starting in accordance with the present invention.

Referring now to FIGS. 4, 5, and 6, a description will be given of a fourth embodiment of the present invention. FIG. 5 shows the structure of the liquid accumulating container, in which an inlet pipe 11 and an outlet pipe 12 are inserted in a liquid accumulating container from a bottom surface thereof, and are open toward the upper portion of the container. In addition, the inserted length of the inlet pipe 11 and the outlet pipe 12 is 5 mm, and the outside diameter of both pipes is 9.52 mm.

Next, a description will be given of the behavior of the refrigerant and the refrigerating machine oil. During the steady-state operation, the high-pressure refrigerant gas compressed by the compressor 1 is discharged together with the refrigerating machine oil having a weight ratio of, for example, 1.0% with respect to the refrigerant, passes through the four-way valve 2, and enters the indoor heat exchanger 3 which is a condenser. The refrigerating machine oil is conveyed by the refrigerant gas which has a sufficient flow rate, and the refrigerating machine oil is completely dissolved in the liquefied liquid refrigerant in the vicinity of the outlet port of the indoor heat exchanger 3. In contrast, during the starting of the compressor 1, there are cases where 2% or more refrigerating machine oil is temporarily discharged together with the refrigerant gas. In this case, the refrigerating machine oil which was not dissolved in the liquid refrigerant inside the indoor heat exchanger 3 assumes the state of oil droplets and is conveyed to the liquid accumulating container together with the liquid refrigerant. However, the limit of solubility of the refrigerating machine oil in the refrigerant under the conditions of condensing pressure and condensing temperature is 1.5% or thereabouts. Since the flow rate of the liquid refrigerant which flowed into the container 10 from the inlet pipe 11 drops, the oil droplets which flowed into the container together with the liquid refrigerant float upward, and form an oil layer 14. Then, when the operating state is stabilized, and the rate of discharge of the refrigerating machine oil decreases to a level below the rate of solubility of the refrigerating machine oil in the refrigerant under the conditions of pressure and temperature within the container 10, the oil in the oil layer 14 is dissolved in a refrigerant 13 in the container, and the thickness of the oil layer 14 decreases gradually. The change in the thickness of the oil layer 14 after the starting of the compressor is shown in FIG. 6. At this juncture, a distribution occurs in the dissolved concentration of the refrigerating machine oil in the liquid refrigerant 10 inside the container 10, and the closer to the oil layer 14, the higher the concentration. In contrast, since the inlet pipe 11 provided in the lower portion of the container is open from below in the upward direction toward the oil layer 14, the current of the refrigerant which has flown in strikes the lower surface of the oil layer 14, so that the oil layer 14 is agitated with the refrigerant 13, and the refrigerant 13 is also agitated at the same time. For this reason, the concentration of the refrigerating machine oil in the refrigerant 13 which is contiguous with the oil layer 14 decreases, and the dissolution of the refrigerating machine oil in the oil layer 14 in the refrigerant 13 is promoted. The dissolved oil is conveyed to outside the container together with the refrigerant from the outlet pipe provided in the lower portion of the container, and returns to the compressor.

It should be noted that even if an oil which is heavier than the refrigerant is used, the oil can be dissolved in the refrigerant by virtue of the above-described structure and the agitating operation, which is effective to the return of the oil to the compressor.

Fifth Embodiment

Figure 7:
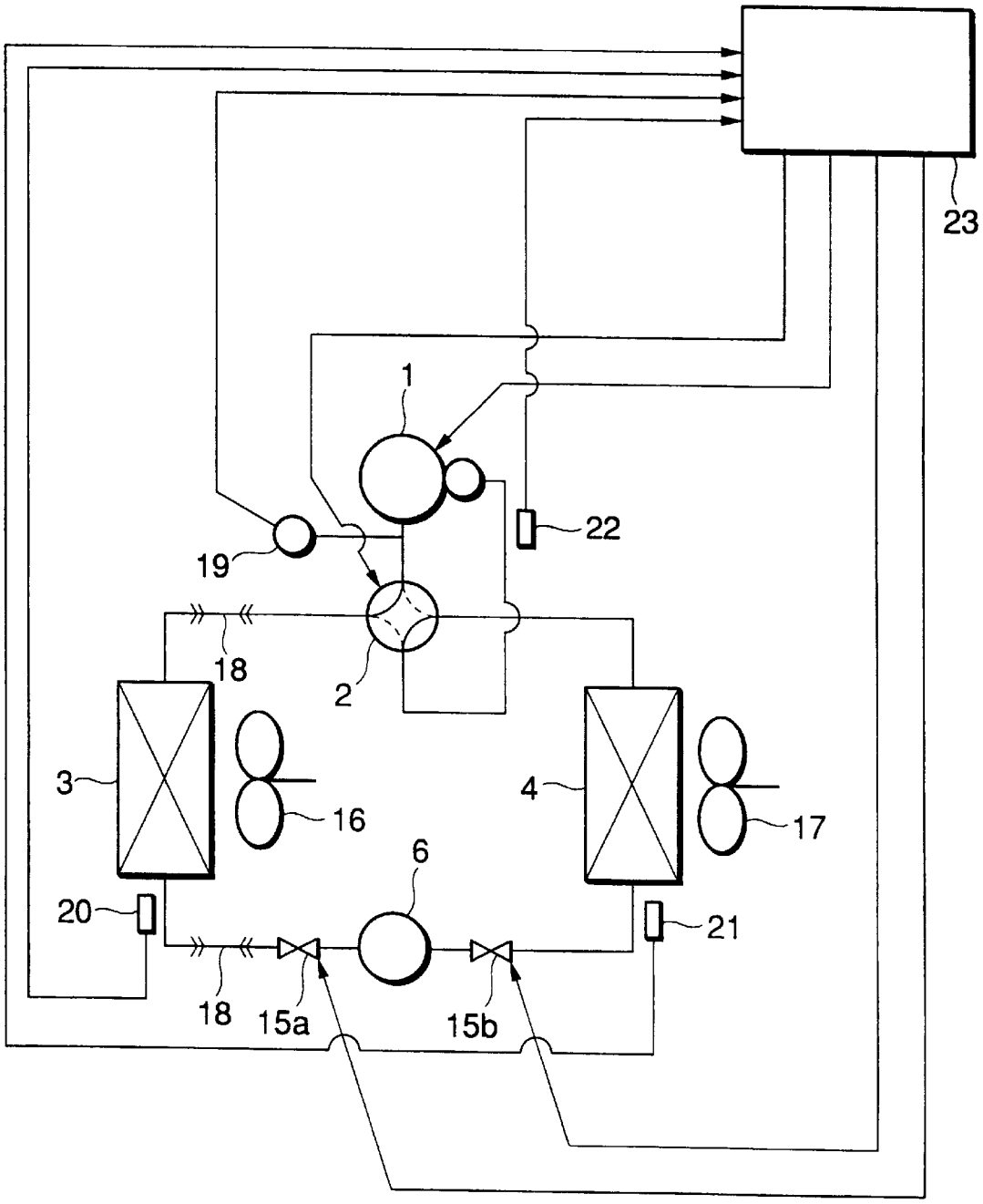
FIG. 7 is a conceptual diagram of the refrigerant circulating apparatus illustrating a still further embodiment of the present invention.

Referring now to FIG. 7, a description will be given of a fifth embodiment of the present invention. FIG. 7 is a diagram illustrating a schematic structure of an embodiment of the refrigerant circulating apparatus in accordance with the present invention. In FIG. 7, reference numeral 1 denotes the compressor for compressing a refrigerant gas; 2, the four-way valve having the function of reversing the flowing direction of the refrigerant, the four-way valve being set in the position for heating operation in the illustrated case; 4, the outdoor heat exchanger for condensing the high-pressure refrigerant gas discharged from the compressor 1; 16, the indoor fan; 3, the indoor heat exchanger; 17, the outdoor fan; 5*a* and 5*b*, the pressure reducing devices; 6, the liquid accumulating container for accumulating surplus refrigerant; 18, the extension pipe connecting the indoor unit and the outdoor unit; 19, a pressure detecting means; 20, a temperature detecting means for detecting the outlet temperature of the indoor heat exchanger; 21, a temperature detecting means for detecting the inlet temperature of the outdoor heat exchanger; 22, a temperature detecting means for detecting the suction temperature of the compressor; and 23, a calculating and controlling device for controlling areas of openings of pressure reducing devices 15*a* and 15*b* on the basis of the data detected by the detecting means 19 to 22.

In the refrigerant circulating apparatus in accordance with the present invention, it is assumed that the areas of openings of the pressure reducing devices 15*a* and 15*b* are being controlled to certain areas, that the liquid refrigerant is accumulated in the liquid accumulating container 6, and that the level of the accumulated liquid is maintained in a stable state. At this time, the refrigerant pressure in the channels including the liquid accumulating container between the pressure reducing devices 15*a* and 15*b* is at a level between the condensing pressure and the evaporating pressure, or at the so-called intermediate pressure, and the liquid refrigerant which is accumulated in the liquid accumulating container 6 is in a saturated state.

Incidentally, the degree of superheating of the refrigerant sucked into the compressor is determined from the respective temperatures detected by the detecting means 22 for detecting the temperature of the refrigerant sucked into the compressor and the detecting means 21 for detecting the inlet temperature of the outdoor heat exchanger as the deviation between the temperatures is calculated by the calculating and controlling device 23. Incidentally, this deviation will be referred to as the degree of superheating.

On the other hand, the degree of subcooling at the outlet of the indoor heat exchanger is determined as the calculating and controlling device 23 calculates the difference between, on the one hand, the saturation temperature of the refrigerant corresponding to the pressure detected by the pressure detecting means 19 and, on the other hand, the detection temperature detected by the detecting means 20 for detecting the refrigerant temperature at the outlet of the indoor heat exchanger. Incidentally, this deviation will be referred to as the degree of subcooling.

It should be noted that the subcooling detecting means for detecting a subcooling characteristic corresponding to the degree of subcooling of the refrigerant at the outlet of the indoor heat exchanger is constituted by a combination of, on the one hand, the detecting means 20 for detecting the refrigerant temperature at the outlet of the indoor heat exchanger and, on the other hand, a detecting means (not shown) for detecting the temperature at the center of the indoor heat exchanger for detecting the temperature in the vicinity of the center of the indoor heat exchanger, which is equivalent to the saturation temperature of the refrigerant corresponding to the pressure detected by the pressure detecting means 19. Alternatively, the deviation between the refrigerant temperature in the vicinity of the center of the indoor heat exchanger and the refrigerant temperature at the outlet of the indoor heat exchanger may be set as the degree of subcooling.

Meanwhile, the subcooling detecting means for detecting a subcooling characteristic value corresponding to the degree of superheating of the sucked refrigerant of the compressor refrigerant is constituted by a combination of a detecting means (not shown) for detecting the outlet temperature of the outdoor heat exchanger for detecting the refrigerant temperature at the outlet of the outdoor heat exchanger and the detecting means 21 for detecting the inlet temperature of the outdoor heat exchanger for detecting the refrigerant temperature at the inlet of the outdoor heat exchanger. Alternatively, the deviation between the outlet and inlet temperatures of the outdoor heat exchanger may be set as the degree of superheating.

Here, if the high-pressure side pressure-reducing device 15*a* is throttled, the pressure is lowered at the outlet of the pressure reducing device 15*a*, and the refrigerant assumes the gas-liquid two-phase state and flows into the liquid accumulating container 6. At this time, since the gas refrigerant and the liquid refrigerant are, respectively, separated into an upper portion and a lower portion in the liquid accumulating container 6 due to the action of gravity, if both the inlet pipe and the outlet pipe of the liquid accumulating container 6 are disposed in the lower portion of the liquid accumulating container, only the liquid refrigerant is always sent to the pressure reducing device 15*b*. In addition, the gasified refrigerant reduces the liquid refrigerant inside the liquid accumulating container 6 due to the gas-liquid two-phase conversion of the refrigerant, thereby lowering the liquid level.

Then, since the liquid refrigerant which is released from the liquid accumulating container 6 during the refrigeration cycle is detained at the outlet of the indoor heat exchanger 3, the degree of superheating becomes large during the refrigeration cycle.

For this reason, the temperature of the refrigerant in the liquid accumulating container 6 is lowered, and the rate of solubility of the refrigerating machine oil in the refrigerant declines. On the other hand, if the high-pressure side pressure reducing device 15*a* is opened to the contrary, a change which is opposite to the case of throttling takes place, and the liquid level rises, while the temperature of the refrigerant in the liquid accumulating container 6 rises, and the rate of solubility of the refrigerating machine oil in the refrigerant increases. Thus, it suffices if the area of the opening in the high-pressure side valve device is increased or decreased in correspondence with targeted values which are set in accordance with the operating condition and the surrounding environment, i.e., in correspondence with targeted settings of the degree of subcooling which are set so as to allow the performance of the air conditioner to be demonstrated fully in accordance with the outdoor air temperature and the set indoor temperature.

Thus, by controlling the high-pressure side pressure reducing device 15*a* in the above-described manner, it is possible to control the degree of subcooling and the temperature of the refrigerant in the liquid accumulating container.

Sixth Embodiment

Meanwhile, if the low-pressure side pressure reducing device 15*b* is opened, the pressure drops at the outlet of the high-pressure side pressure reducing device 15*a*, and the refrigerant assumes the gas-liquid two-phase state and flows into the liquid accumulating container 6. At this time, since the gas refrigerant and the liquid refrigerant are, respectively, separated into an upper portion and a lower portion in the liquid accumulating container 6 due to the action of gravity, if both the inlet pipe and the outlet pipe of the liquid accumulating container 6 are disposed in the lower portion of the liquid accumulating container, only the liquid refrigerant is always sent to the pressure reducing device 15*b*. In addition, the gasified refrigerant reduces the liquid refrigerant inside the liquid accumulating container 6 due to the gas-liquid two-phase conversion of the refrigerant, thereby lowering the liquid level.

Then, since the flow rate of the refrigerant increases at the outlet of the low-pressure side pressure reducing device 15*b*, the degree of superheating in compressor suction declines.

If the low-pressure side pressure reducing device 15*b* is throttled to the contrary, the degree of superheating in compressor suction increases. Thus, it suffices if the area of the opening in the low-pressure side valve device is increased or decreased in correspondence with targeted values which are set in accordance with the operating condition and the surrounding environment, i.e., in correspondence with targeted settings of the degree of superheating which are set so as to allow the performance of the air conditioner to be demonstrated fully in accordance with the outdoor air temperature and the set indoor temperature.

Thus, by controlling the low-pressure side pressure reducing device 15*b* in the above-described manner so as to control the degree of superheating in compressor suction, i.e., the dryness fraction, to an optimum value, it is possible to further expand the available pressure and temperature, thereby making it possible to make the apparatus efficient and maintain an operating condition which requires less energy.

Seventh Embodiment

Further, by controlling the high-pressure side pressure reducing device 15*a* and the low-pressure side pressure reducing device 15*b* in an interlocking manner, the degree of subcooling and the degree of superheating can be controlled to predetermined values, thereby making it possible to maintain an operating state in which input energy is small. This can be operation with minimum energy under the given conditions.

Eighth Embodiment

Referring now to FIGS. 5 and 7, a description will be given of another embodiment of the present invention. Electrically-operated expansion valves which are controlled by a microcomputer are used as the pressure reducing devices 15*a* and 15*b*, as shown in FIG. 7. Then, control is provided such that the relationship between the pressure and temperature within the liquid accumulating container assumes a saturated state. In this state, if control is provided such that the area of the opening in the inlet-side expansion valve 15*a* becomes small, and the area of the opening in the outlet-side expansion valve 15*b* becomes large, the state of the refrigerant passing through the inlet pipe 11 shown in FIG. 5 changes from that of the saturated liquid to the gas-liquid two-phase state. Consequently, bubbles are produced from the inlet pipe 11, and the bubbles thus produced agitate the refrigerant 13 while rising through the refrigerant 13 inside the container, and when they reach the oil layer 14, they agitate the oil layer 14 and the refrigerant 13.

If this state is continued, the amount of refrigerant accumulated in the container decreases, so that after the lapse of a certain time duration the areas of openings in the expansion valves 15*a* and 15*b* are controlled such that the state of the refrigerant in the inlet pipe 11 becomes that of a subcooled liquid.

Thus, as the bubbles are produced in the container, and the refrigerant 13 and the oil layer 14 are agitated by the bubbles, the dissolution of the detained refrigerating machine oil in the refrigerant is promoted. Although a description has been given of the case in which agitation is effected by producing bubbles, agitation may be effected by a change in the flow rate accompanying a pressure change. This control may be provided appropriately, for example, for each fixed time or each compressor operating time during the operation, or the fact that the oil has been accumulated in the container may be detected by detecting the heightwise temperature of the container.

It should be noted that, as a change which is imparted to the refrigerant, a description has been given of the case in which the change is imparted by the pressure reducing devices, but the state of the refrigerant may be changed by various methods, such as the one in which a changeover circuit is provided in an outlet portion of the inlet pipe, and pressure changes using an orifice are repeatedly imparted.

Ninth Embodiment

Referring now to FIGS. 5 and 7, a description will be given of another embodiment of the present invention. Electrically-operated expansion valves which are controlled by a microcomputer are used as the pressure reducing devices 15*a* and 15*b*, as shown in FIG. 7. Then, control is provided such that the relationship between the pressure and temperature within the liquid accumulating container assumes a saturated state. In this state, if control is provided such that the area of the opening in the inlet-side expansion valve 15*a* becomes small, and the area of the opening in the outlet-side expansion valve 15*b* becomes large, the state of the refrigerant passing through the inlet pipe 11 shown in FIG. 5 changes from that of the saturated liquid to the gas-liquid two-phase state. In this state, the refrigerant 13 in the container gradually decreases, and this state is continued until the refrigerant 13 is depleted. Subsequently, the expansion valves are controlled such that the state of the refrigerant in the inlet pipe 11 becomes that of the subcooled liquid so as to accumulate the refrigerant again. As the liquid level of the refrigerant 13 disappears, the oil layer 14 is conveyed from the outlet pipe 12 to outside the container. Then, when the refrigerating machine oil has been conveyed to outside the container, control is provided for accumulating the refrigerant inside the container. If this control is effected once at the time when the thickness of the oil layer is under the condition of being large inside the container after the starting of the compressor, it is possible to convey to outside the container the refrigerating machine oil which is detained inside the container, and to return the same to the compressor. Incidentally, the presence or absence of the liquid level can be detected by detecting the heightwise temperature of the container.

As described above, it becomes possible to realize a circuit and a controlling method which will not detain the oil in the container even if an oil which is difficult to dissolve in a refrigerant is used, and if a liquid accumulating container, such as a receiver, an accumulator, or a header, is provided in the refrigerant circuit. Consequently, it is possible to return the refrigerating machine oil reliably to the compressor without detaining a large amount of oil in the liquid accumulating container, proper lubricating and sealing functions can be maintained for the interior of the compressor, and it is possible to reliably maintain the performance suitable for the condition of the load by accumulating the surplus refrigerant in the refrigerant circuit. Further, the surplus refrigerant can be accumulated in correspondence with the flowing direction of the refrigerant in the apparatus, and it becomes possible to make full use of the capabilities of the apparatus and operate the apparatus flexibly. In addition, it becomes possible to prevent excess refrigerant from flowing to the compressor, thereby making it possible to improve the reliability of the compressor.

In addition, in accordance with the present invention, the liquid refrigerant can be accumulated in the liquid reservoir without accumulating the oil, or the liquid refrigerant can be emptied of the liquid reservoir, and an optimum operating state can be set during starting or in correspondence with the condition of the load while maintaining the reliability of the compressor. Further, even if the oil is temporarily detained in the liquid accumulating container, it is possible to either return the oil rapidly to the compressor or reduce the amount of oil detained by causing the oil to be gradually dissolved in the refrigerant without exerting an effect on the operating performance. It is possible to promote the dissolution of the oil in the refrigerant by agitating the refrigerant inside the container by making use the velocity of the refrigerant which flows into the container, and it is possible to reliably effect the conversion of oil without impairing the reliability of the compressor.

It should be noted that it is possible to adopt a structure for facilitating agitation by forming the liquid accumulating container in a narrow and deep shape.

Further, in a case where the flow rate of the refrigerant flowing into the container is slow and the agitation effect is small, the dissolution of the oil in the refrigerant can be promoted by changing the state of the refrigerant inside the container.

10th Embodiment

Figure 8:
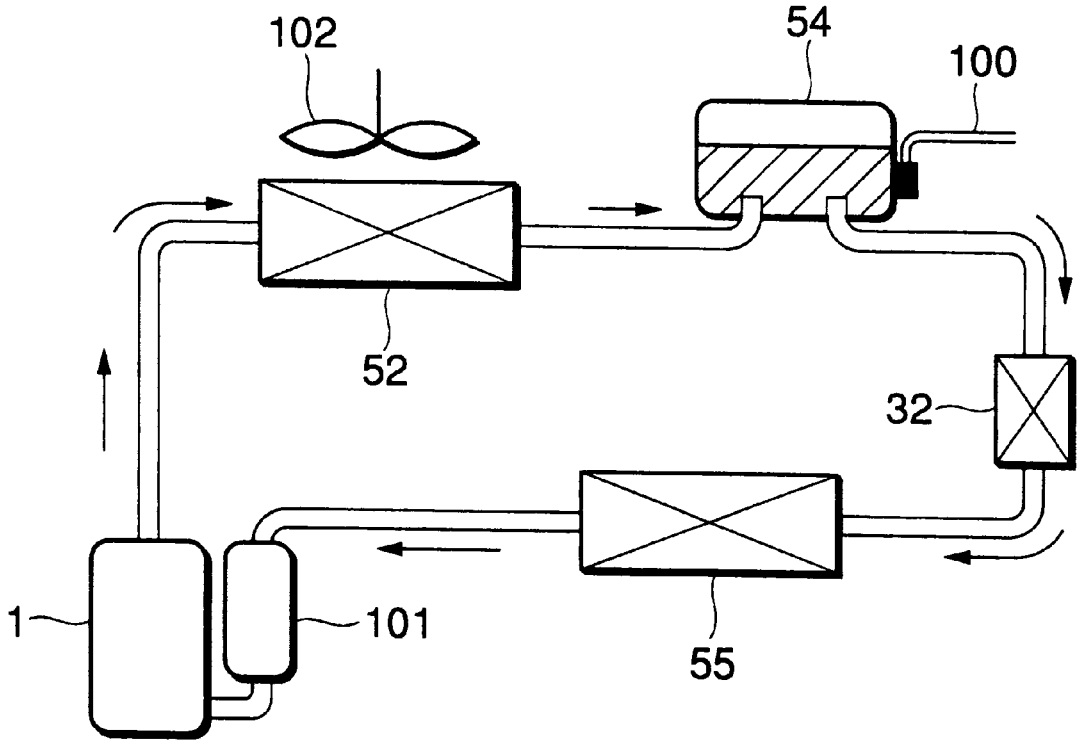
FIG. 8 is a schematic diagram of a refrigerating and air-conditioning apparatus illustrating a further embodiment of the present invention.
Figure 9A:
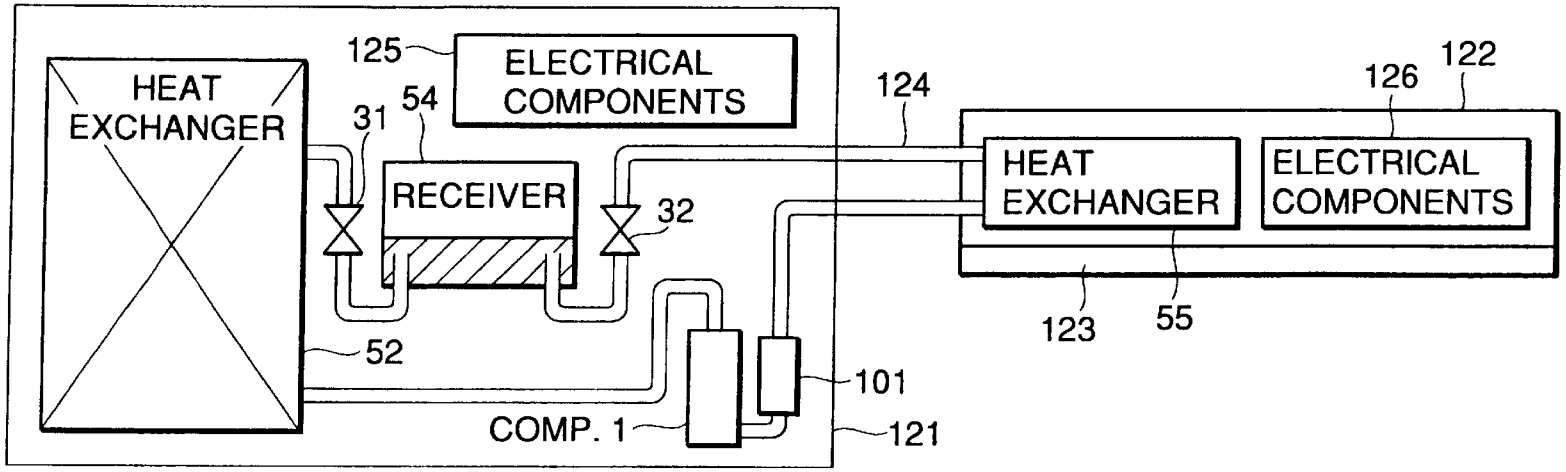
FIG. 9 is a schematic diagram of the refrigerating and air-conditioning apparatus illustrating the further embodiment of the present invention.
Figure 9B:
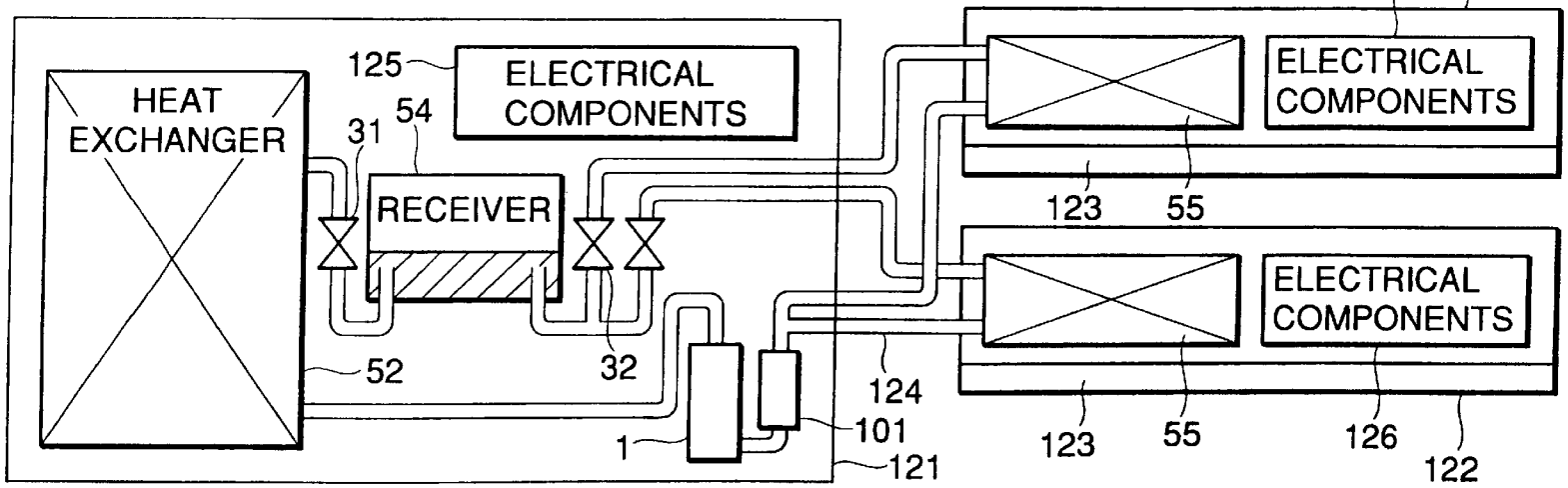
Figure 10A:
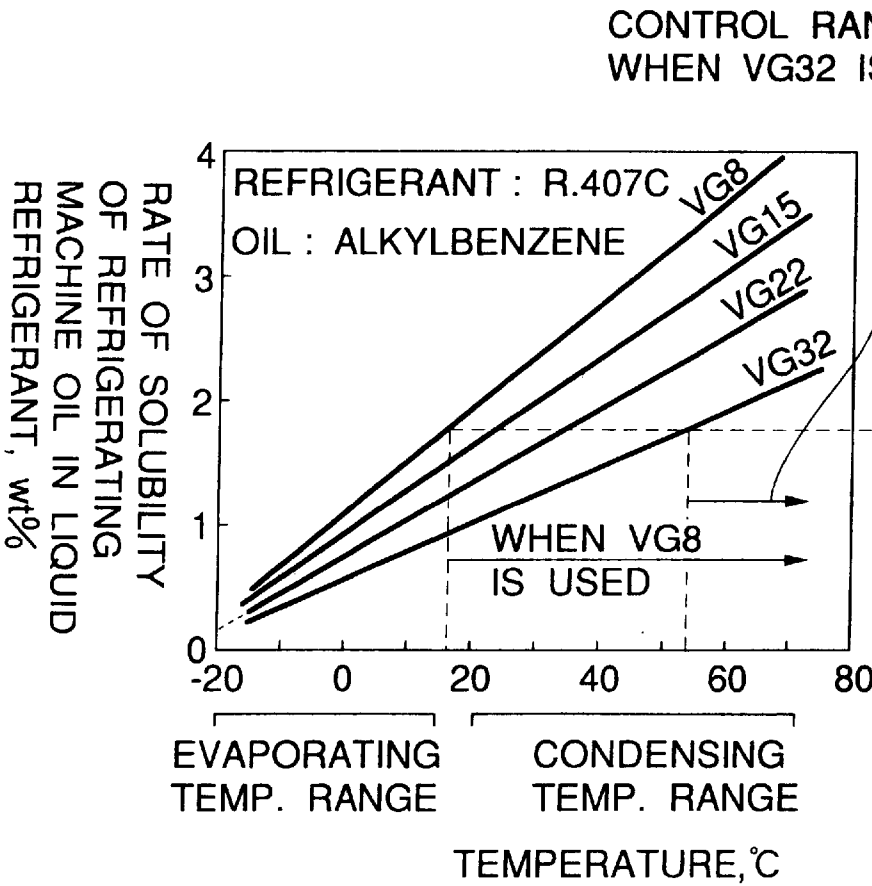
FIG. 10 is a diagram illustrating the rate of solubility of a refrigerating machine oil in a liquid refrigerant and the relationship between the oil circulation rate and the compressor frequency in accordance with the present invention.
Figure 10B:
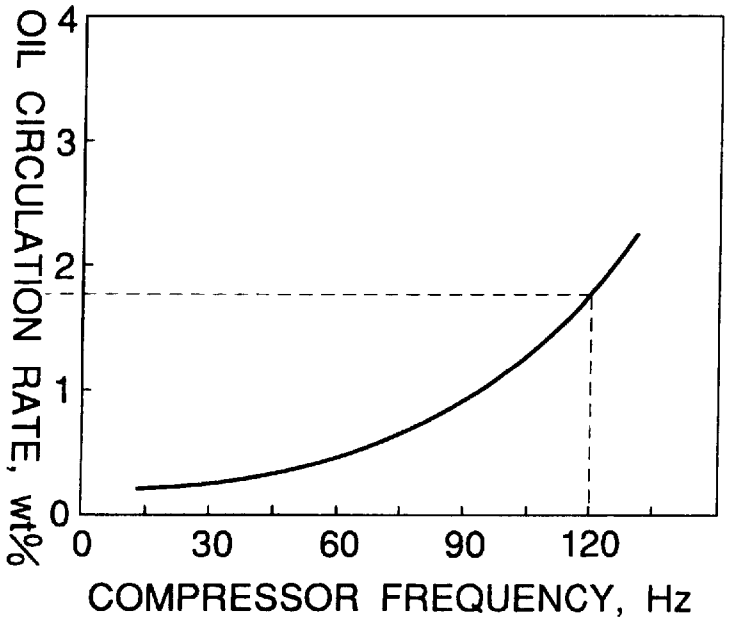

Referring now to FIGS. 8, 9, and 10, a description will be given of a 10th embodiment of the present invention.

FIG. 8 shows a configuration of a refrigerant circuit for circulating the refrigerant in the refrigerating and air-conditioning apparatus, wherein reference numeral 1 denotes the compressor; 52, a condenser; 54, a receiver (liquid accumulating container) for accumulating the surplus refrigerant; 55, an evaporator; 32, an opening/closing valve which is a pressure reducing device for reducing the pressure of the refrigerant on the high-pressure side; 100, a thermistor for detecting the temperature of the interior of the receiver 4 in a saturated state; 101, a muffler which is a part of the compressor 1 for delaying the flow of the refrigerant; and 102, a fan for the condenser.

In FIG. 8, if the refrigerant circuit is for an air conditioner as shown in FIG. 9, in FIG. 9, reference numeral 121 denotes an outdoor unit which incorporates therein the heat exchanger 52, i.e., the condenser, electrical components 125, the compressor 1, and the receiver 54; 122, an indoor unit having the heat exchanger 55, i.e., the evaporator, electrical components 126, and a blow port 123; and 124, an extension pipe for circulating the refrigerant between the outdoor unit 121 and the indoor unit 12.

FIG. 9(*a*) corresponds to a normal room air conditioner in which one indoor unit 122 is provided for one outdoor unit 121, while FIG. 9(*b*) shows an example of the multi-type air conditioner in which a plurality of indoor units are provided for one outdoor unit 121.

The refrigerant which is compressed by the compressor 1 is condensed by the condenser 52, is subjected to pressure reduction by the expansion opening/closing valve 32, is evaporated by the evaporator 55, and is returned to the compressor 1.

The refrigerating machine oil as lubricating oil for the sliding portions of the compressor is stored in the compressor 1. Although a very small amount of refrigerating machine oil flows out from the compressor to the refrigerant circuit together with the refrigerant, if a refrigerating machine oil is used which scarcely dissolves in a refrigerant using hydrofluorocarbon, such as a refrigerating machine oil, alkylbenzene, a mineral oil, an ester oil, an ether oil, or the like which has nonsolubility or very weak solubility with respect to, for example, an HFC-based refrigerant, with its rate by weight of solubility in the liquid refrigerant under the conditions of condensing pressure and condensing temperature being 0.5–7 wt %, and its rate by weight of solubility in the liquid refrigerant under the conditions of evaporating pressure and evaporating temperature being 0–0.20 wt %, then the refrigerating machine oil which is mixed with the refrigerant is detained inside the receiver in the refrigerant circuit having the liquid pooling section, i.e., the receiver for accumulating the surplus refrigerant, where the moving velocity of the refrigerant becomes slow.

The rate by weight of solubility of the refrigerating machine oil in the above-described refrigerant changes depending on the kinds of refrigerant and refrigerating machine oil. The aforementioned rates by weight of solubility are obtained through various combinations with respect to the various kinds of refrigerating machine oil enumerated above.

FIG. 10 shows the rate of solubility of refrigerating machine oil alkylbenzene (viscosity grade VG=8–32) in the liquid refrigerant R.407C, which is an HFC-based refrigerant in this embodiment, as well as the relationship between the oil circulation rate and the compressor frequency. As shown in FIG. 10(*a*), the refrigerating machine oil exhibits a rate of solubility of 1.0–4.0 wt % with respect to the liquid refrigerant in the condensing temperature range of +20° C.–+70° C., but exhibits a very small rate of solubility of 0.2–1.8 wt % with respect to the liquid refrigerant in the evaporating temperature range of −20° C.–+15° C. In addition, the lower the viscosity of the refrigerating machine oil, the greater the rate of solubility in the liquid refrigerant. As shown in FIG. 10(*b*), the oil circulation rate, i.e., a weight ratio of the refrigerating machine oil which flows with the refrigerant from the compressor to the refrigerant, generally assumes a value of 0.3–2.0 wt % or thereabouts, and tends to increase with the rise of the compressor frequency.

Thus, the refrigerating machine oil circulates in the refrigerant circuit in an amount which is shown by the oil circulation rate, and the refrigerating machine oil dissolves in the liquid refrigerant inside the receiver 54 within the range of its rate of solubility at that temperature. However, in a case where the oil circulation rate has become higher than the rate of solubility of the refrigerating machine oil in the liquid refrigerant under certain operating conditions, the amount of the refrigerating machine oil which is circulated exceeds an allowable amount of dissolution in the liquid refrigerant inside the receiver 54. Consequently, the refrigerating machine oil is separated from the liquid refrigerant, and assumes the state of oil droplets or an oil layer. Then, since the flow rate of the refrigerant is appreciably lower in the receiver than in the pipe, the refrigerating machine oil is detained in a large amount without being conveyed, and ceases to be returned to the compressor. Accordingly, it becomes necessary to allow the refrigerating machine oil to dissolve in the liquid refrigerant so as to reliably return the refrigerating machine oil in the receiver.

For example, the temperature of the liquid refrigerant inside the receiver 54 in the circuit such as the one shown in FIG. 8 is detected by the thermistor 100, and if the temperature of the liquid refrigerant has become lower than the temperature necessary for dissolution of the refrigerating machine oil, the solenoid expansion valve 32 is operated in the closing direction, or the number of revolutions of the fan 102 of the condenser 52 is lowered, which in turn causes the temperature of the liquid refrigerant in the receiver 54 to rise, thereby making it possible to dissolve the refrigerating machine oil.

Alternatively, to lower the temperature of the liquid refrigerant in the receiver 54, it suffices if the expansion valve 32 is operated in the opening direction, or the number of revolutions of the fan 102 of the condenser 52 is increased, or if both of these operations are carried out. The control of these operations is effected by the electrical components 125 inside the outdoor unit 121.

It should be noted that although, in the above description, an example has been shown in which control is effected by detecting the temperature of the refrigerant in the receiver, since the temperature is primarily determined with respect to the pressure in a case where the refrigerant in the receiver is in the gas-liquid two-phase state, similar control may be carried out by detecting the pressure by means of a pressure sensor or the like.

In the refrigeration cycle apparatus in accordance with the present invention, by taking into account the rate of solubility of the refrigerating machine oil in the liquid refrigerant and the relationship between the oil circulation rate and the compressor frequency such as those shown in FIG. 10(*a*), the temperature and pressure of the liquid refrigerant in the receiver and the viscosity grade of the refrigerating machine oil are set so as to allow the state of dissolution of the refrigerating machine oil in the liquid refrigerant to be constantly maintained during the operation. For instance, if a refrigerating machine oil of a viscosity grade VG32 is used in a refrigeration cycle apparatus in which the receiver is disposed between the condenser and the pressure reducing device, as shown in FIG. 10, the temperature of the liquid refrigerant in the receiver is controlled within the range of the region indicated by the arrow when the compressor frequency is 120 Hz, so that the refrigerating machine oil is dissolved in the liquid refrigerant. Accordingly, the refrigerating machine oil is reliably conveyed in a state of being dissolved in the liquid refrigerant without being detained in the receiver. Further, if a refrigerating machine oil of a viscosity grade VG8 is used in this refrigeration cycle apparatus, the range of solubility of the refrigerating machine oil expands as indicated by the dotted line, leeway is produced in the aforementioned control range for returning the oil, and the return of the oil is made more reliable. Moreover, subcooling can be controlled in correspondence with the condition of the load of the apparatus, thereby improving the efficiency and performance of the refrigerating and air-conditioning apparatus. To set subcooling to a low level, it suffices if the expansion valve is operated in the opening direction, or the number of revolutions of the fan is lowered, or both of these operations is carried out. To set subcooling to a high level, it suffices if an opposite operation is carried out.

That is, in the case of the refrigerating and air-conditioning apparatus in accordance with the present invention, in the refrigerant circuit which uses a hydrofluorocarbon- (HFC-) based refrigerant as a refrigerant and alkylbenzene or other similar oil having weak compatibility with respect to the HFC-based refrigerant as a refrigerating machine oil sealed in the compressor and which has a receiver for accumulating surplus refrigerant, the temperature or pressure in the receiver and the viscosity grade of the refrigerating machine oil are set such that the rate of solubility of the refrigerating machine oil in the liquid refrigerant becomes higher than the oil circulation rate of the refrigerating machine oil which flows out from the compressor together with the refrigerant.

As a result, the refrigerating machine oil is conveyed reliably in the state of being dissolved in the liquid refrigerant without being detained in the receiver in a large amount.

11th Embodiment

Figure 11:
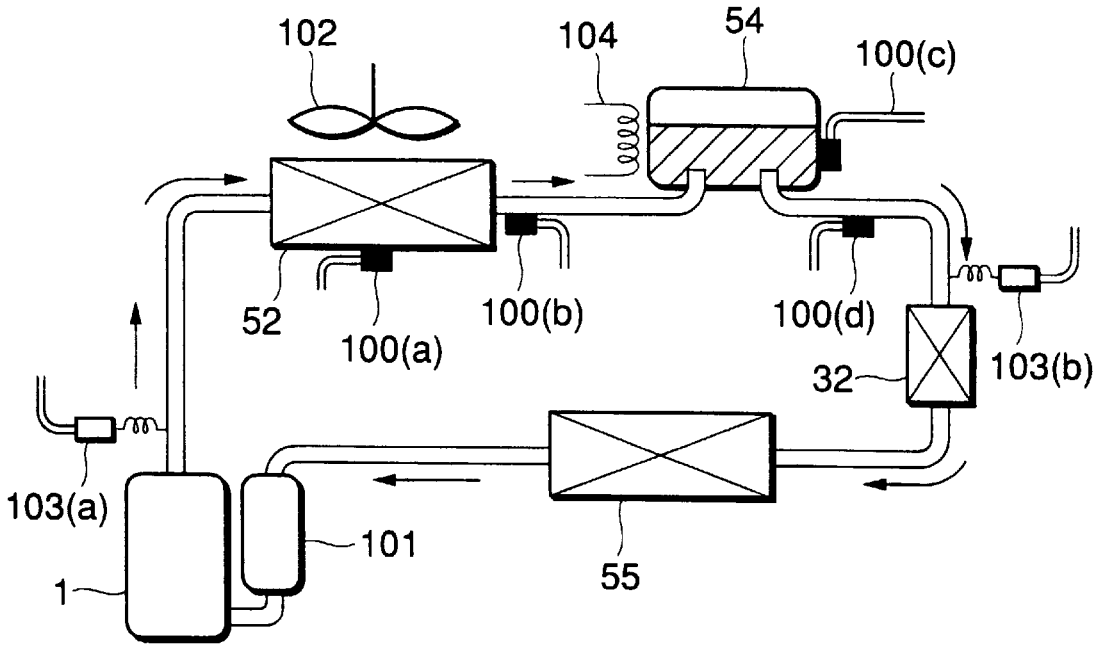
FIG. 11 is a schematic diagram of the refrigerating and air-conditioning apparatus illustrating a further embodiment of the present invention.
Figures 12A, 12B, 12C:
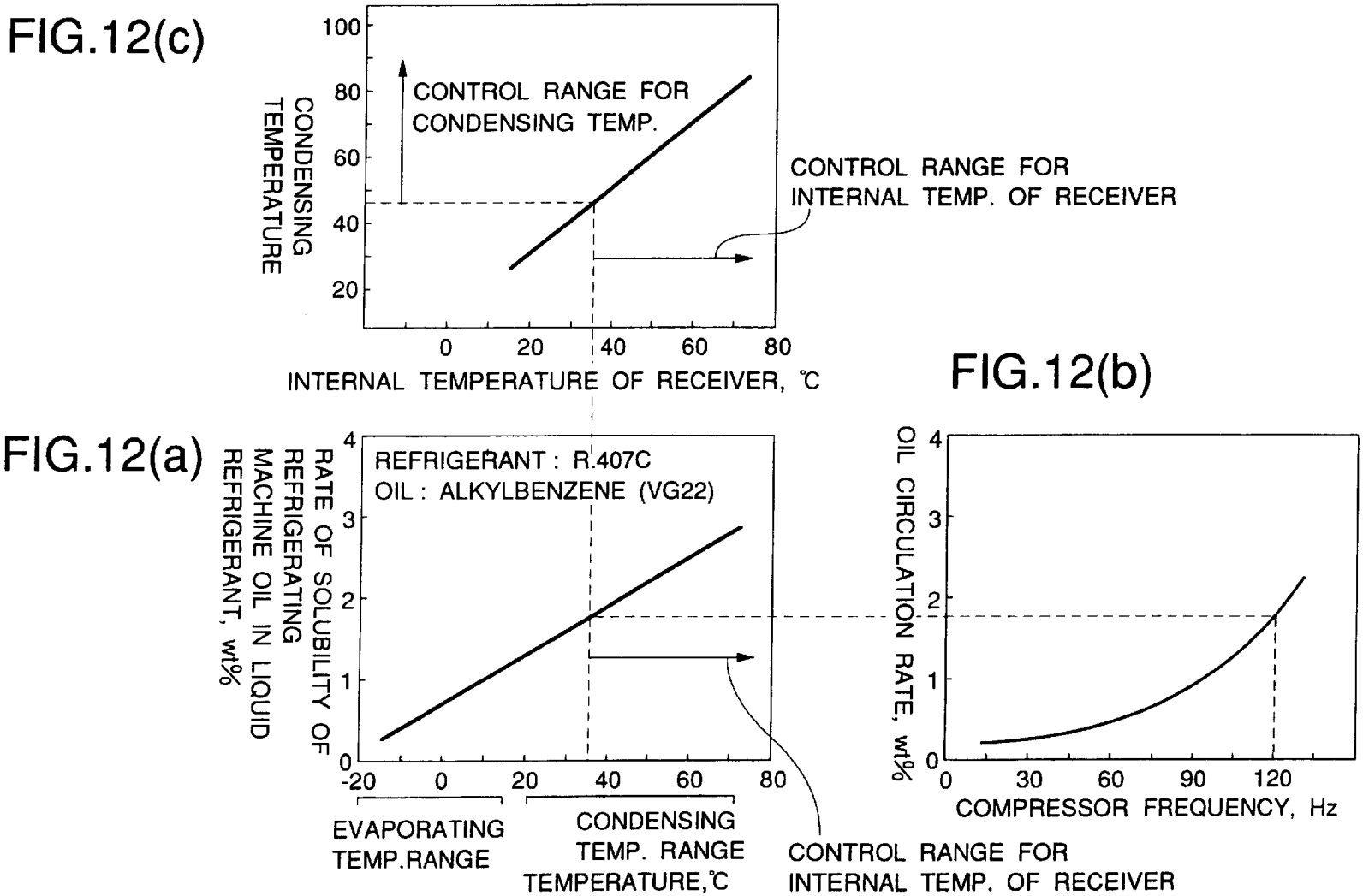
FIG. 12 is a diagram illustrating the rate of solubility of the refrigerating machine oil in the liquid refrigerant, the relationship between the oil circulation rate and the compressor frequency, and the relationship between the condensing temperature and the internal temperature of a receiver in accordance with a further embodiment of the present invention.

Referring now to FIGS. 11 and 12, a description will be given of an 11th embodiment of the present invention.

FIG. 11 shows a configuration of a refrigerant circuit for circulating the refrigerant in the refrigerating and air-conditioning apparatus, wherein reference numeral 1 denotes the compressor; 52, the condenser; 54, the receiver for accumulating the surplus refrigerant; 55, the evaporator; 32, the opening/closing valve which is a pressure reducing device for reducing the pressure of the refrigerant on the high-pressure side; 100, the thermistors for detecting the temperature, the thermistor 100(*a*) being disposed at an intermediate position on the condenser, the thermistor 100 (*b*) being disposed between the outlet of the condenser and the receiver 54, the thermistor 100(*c*) being disposed at the receiver 54, and the thermistor 100(*d*) being disposed between the receiver 4 and the pressure reducing device 32. Numeral 102 denotes the fan for the condenser. Numeral 103 denotes sensors, the sensor 103(*a*) being disposed between the discharge pipe of the compressor and the condenser 52, and the sensor 103(*b*) being disposed between the condenser 52 and the pressure reducing device 32. Numeral 104 denotes a heater for heating the refrigerant in the receiver 54.

In addition, FIG. 12(*a*) shows the rate of solubility of refrigerating machine oil alkylbenzene (viscosity grade 22) in the liquid refrigerant R.407C, FIG. 12(*b*) shows the relationship between the oil circulation rate and the compressor frequency, and FIG. 12(*c*) shows the relationship between the condensing temperature and the internal temperature of the receiver.

As described above, to allow the refrigerating machine oil to dissolve in the liquid refrigerant in the receiver, the internal temperature of the receiver is set such that the rate of solubility of the refrigerating machine oil in the liquid refrigerant becomes higher than the oil circulation rate of the refrigerating machine oil. For this reason, a means for detecting the internal temperature of the receiver and controlling the same is required.

To detect the internal temperature of the receiver, it suffices if at least one of the thermistors 100(*a*) to 100(*d*) and the pressure sensors 103(*a*) and 103(*b*) is provided.

In the case where the thermistors 100(*b*) to 100(*d*) are provided, since the temperature of the refrigerant does not change from the outlet of the condenser to the pressure reducing device, it is possible to directly detect the internal temperature of the receiver. Meanwhile, in the case where the thermistor 100(*a*) and the pressure sensor 103 are provided, since the condensing temperature of the refrigerant can be detected, it is possible to estimate the internal temperature of the receiver. For example, when the compressor frequency is 120 Hz as shown in FIG. 12(*b*), it suffices if the temperature of the liquid refrigerant in the receiver is controlled within the range indicated by the arrow. For this purpose, it suffices if the condensing temperature is controlled within the range indicated by the arrow, as shown in FIG. 12(*c*).

In addition, to control the temperature of the liquid refrigerant in the receiver, in addition to using the pressure reducing device and the condenser fan mentioned above, it is possible to adopt a method is which direct heating is effected by the heater 104, as shown in FIG. 11.

12th Embodiment

Figure 13:
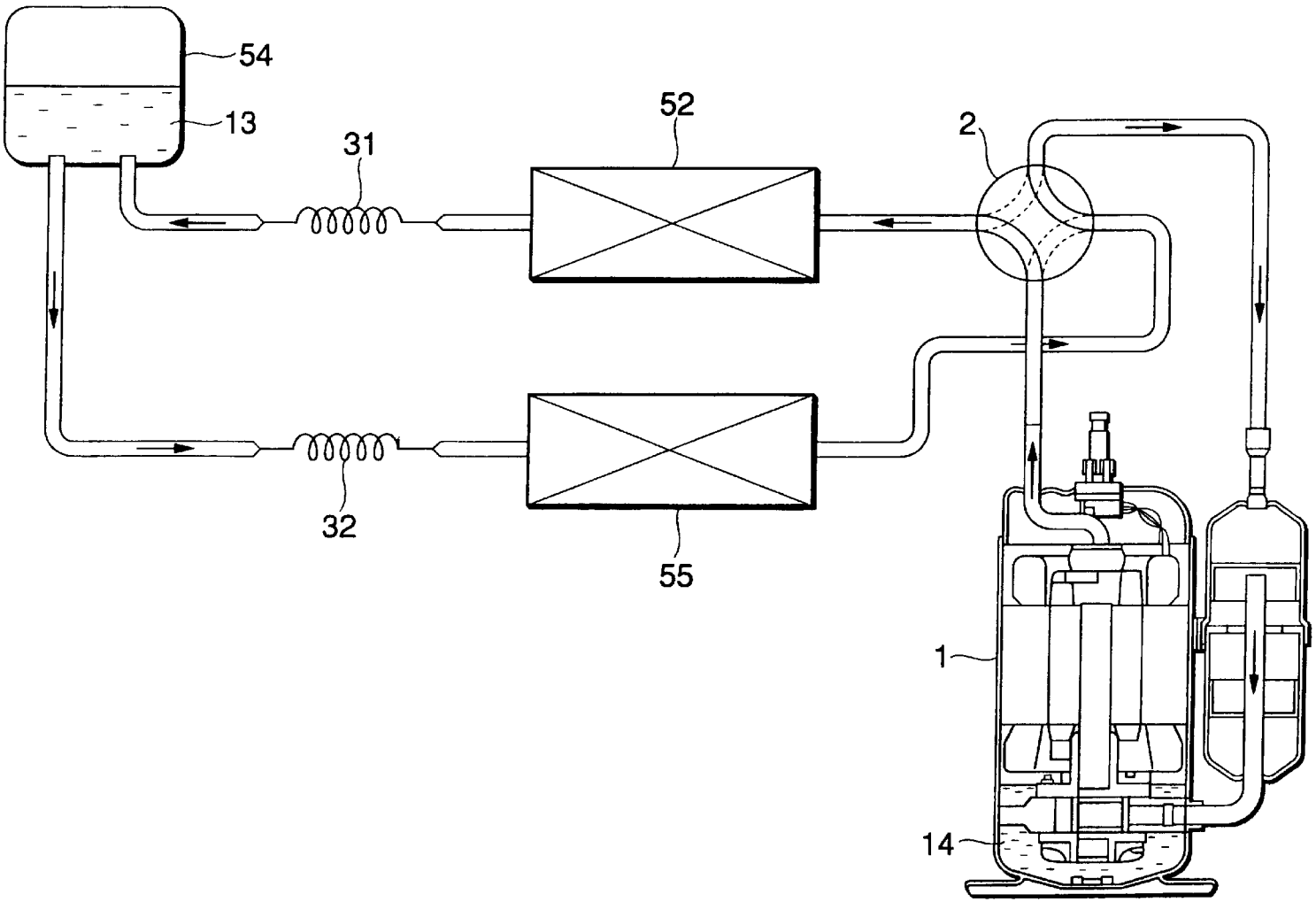
FIG. 13 is a schematic diagram of the refrigerating and air-conditioning apparatus illustrating the further embodiment of the present invention.

Referring now to FIGS. 12 and 13, a description will be given of a 12th embodiment of the present invention.

FIG. 13 is another example of the refrigerating and air-conditioning apparatus which is applied to an air conditioner, for example. In FIG. 13, reference numeral 1 denotes the compressor for compressing a refrigerant gas; 52, the condenser for condensing the high-pressure refrigerant gas discharged from the compressor 1; 31, a pre-stage pressure reducing device; 54, the receiver for accumulating surplus refrigerant; 32, the post-stage pressure reducing device; 55, the evaporator; 2, the four-way valve having the function of reversing the flowing direction of the refrigerant; 14. the refrigerating machine oil stored in the compressor 1 to effect the lubrication of the sliding portions of the compressor 1 and the sealing of the compression chamber; and 13, the surplus liquid refrigerant accumulated in the receiver 54. In addition, FIG. 12(*a*) shows the rate of solubility of refrigerating machine oil alkylbenzene (viscosity grade VG22) in the liquid refrigerant R.407C, and FIG. 12(*b*) shows the relationship between the oil circulation rate and the compressor frequency. The refrigerating machine oil exhibits a rate of solubility of 1.3–2.8 wt % with respect to the liquid refrigerant in the condensing temperature range of +20 C.–+70° C., but exhibits a very small rate of solubility of 0.2–1.2 wt % with respect to the liquid refrigerant in the evaporating temperature range of −20° C.–+15° C. In addition, the oil circulation rate, i.e., a weight ratio of the refrigerating machine oil which flows with the refrigerant from the compressor to the refrigerant, assumes a value of 0.3–2.0 wt % or thereabouts, and tends to increase with the rise of the compressor frequency.

Next, a description will be given of the behavior of the refrigerant and the refrigerating machine oil. The high-pressure refrigerant gas compressed by the compressor 1 is discharged to the condenser 52. Most of the refrigerating machine oil 14 used for lubricating the compressor and for sealing the compression chamber returns to the bottom of the hermetic container, but the refrigerating machine oil having an oil circulation rate of 0.3 to 2.0 wt % or thereabouts is discharged together with the refrigerant from the compressor 1 and enters the condenser 52. The refrigerating machine oil is conveyed by the refrigerant gas having a sufficient flow rate, is dissolved in the liquefied liquid refrigerant in the vicinity of the outlet of the condenser 52, and is conveyed to the pre-stage pressure reducing device 31. The liquid refrigerant whose pressure is reduced to so-called intermediate pressure by the pre-stage pressure reducing device 31 enters the receiver (liquid accumulating container) 54. Here, by controlling the pressure reducing devices disposed respectively before and after the receiver 54, the surplus refrigerant can be accumulated in correspondence with the condition of the load of the apparatus. In addition, the internal temperature of the receiver 54 is set by controlling the intermediate pressure by means of the pressure reducing devices such that the rate of solubility of the refrigerating machine oil in the liquid refrigerant 13 inside the receiver 54 becomes higher than the oil circulation rate. For example, in a case where the compressor frequency is 120 Hz as shown in FIG. 12(*a*), the temperature of the liquid refrigerant 13 in the receiver 54 is controlled within the range of the region indicated by the arrow as shown by the dotted line in FIG. 12(*b*), so that the refrigerating machine oil dissolves in the liquid refrigerant 13. Accordingly, the refrigerating machine oil is conveyed reliably in the state of being dissolved in the liquid refrigerant 13 without being detained in the receiver 54 in a large amount. The liquid refrigerant which flowed out from the receiver 54 is further subjected to pressure reduction to the level of necessary evaporating pressure, so that the temperature declines sharply. Hence, the solubility characteristic of the refrigerating machine oil changes to nonsolubility or very weak solubility with respect to the liquid refrigerant, and the refrigerating machine oil which cannot be dissolved in the liquid refrigerant is separated and forms oil droplets. However, the refrigerating machine oil is conveyed through the evaporator 55 since the flow rate of the refrigerant increases abruptly due to the gasification of part of the liquid refrigerant which occurs in the post-stage pressure reducing device 32, and since, for instance, the pipe diameter of the evaporator 55 in the next stage is set so as to secure a flow rate of the refrigerant gas sufficient to convey the refrigerating machine oil downstream. Then, the refrigerating machine oil sucked into the compressor 1 returns to the bottom of the hermetic container.

FIG. 13 shows an example in which, instead of expansion valves which are throttle valves, capillary tubes are used as the aforementioned pre- and post-stage pressure reducing devices.

In the case where the capillary tubes are used as the pressure reducing devices, the inside diameter and length of the capillary tubes are set so that the refrigerating machine oil will be dissolved in the liquid refrigerant inside the receiver under any operating conditions. The smaller the inside diameter and the longer the capillary tubes, the greater pressure-reducing effect can be obtained, so that it is possible to obtain an advantage similar to that of the closing of the valves.

Since the pressure reduction and expansion using the capillary tubes have self-adjusting capabilities over a certain temperature range, the operation can be performed in a region selected and set in advance in correspondence with a predetermined refrigerant and a predetermined refrigerating machine oil, so that it becomes possible to reliably return the refrigerating machine oil to the compressor. By applying the capillary tubes thus set to the refrigerant circuit and by sealing in the predetermine refrigerating machine oil and refrigerant, a refrigerating and air-conditioning apparatus such as a refrigerator or an air conditioner which incorporates this refrigerant circuit is assembled.

The refrigerating and air-conditioning apparatus of the present invention such as the one shown in FIG. 13 is arranged as follows: The compressor, the four-way valve having the function of reversing the flowing direction of the refrigerant, the condenser, the pre-stage pressure reducing device, the receiver for accumulating the surplus refrigerant, the post-stage pressure reducing device, and the evaporator are consecutively connected by refrigerant pipes, and the temperature and pressure of the liquid refrigerant in the receiver are set by the pressure reducing devices disposed respectively before and after the receiver, such that the rate of solubility of the refrigerating machine oil in the liquid refrigerant becomes higher than the oil circulation rate of the refrigerating machine oil which flows out from the compressor together with the refrigerant. Accordingly, the refrigerating machine oil can be reliably conveyed in the state of being dissolved in the liquid refrigerant without being detained in the receiver in a large amount.

13th Embodiment

Figure 14:
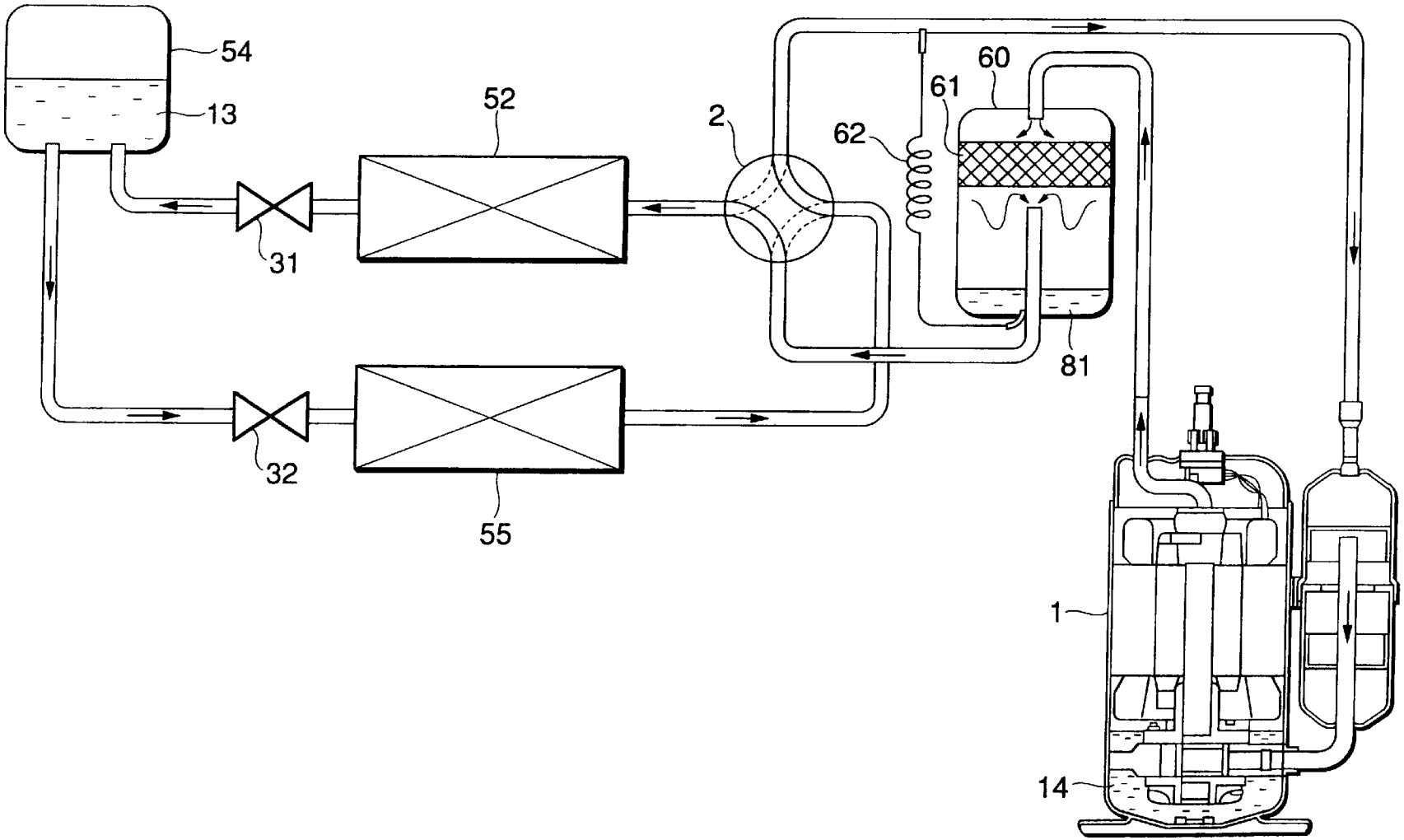
FIG. 14 is a schematic diagram of the refrigerating and air-conditioning apparatus illustrating a further embodiment of the present invention.
Figure 15A:
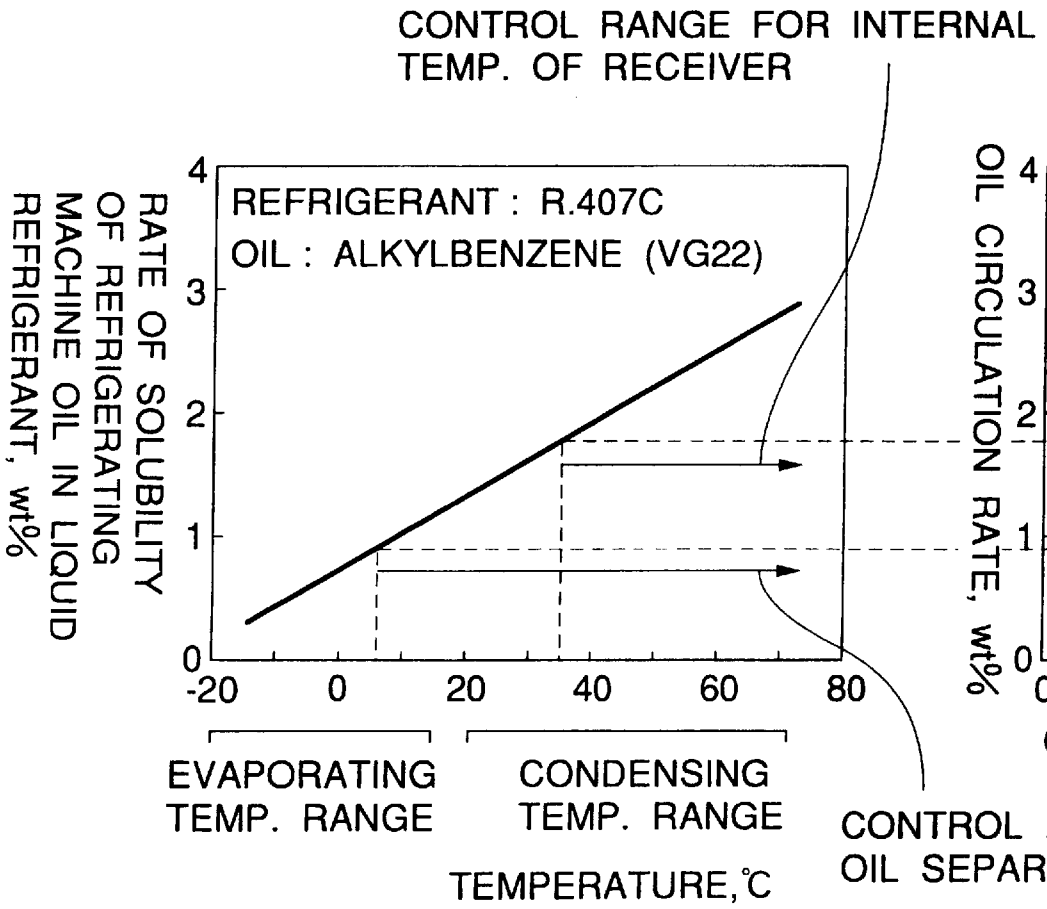
FIG. 15 is a diagram illustrating the rate of solubility of the refrigerating machine oil in the liquid refrigerant and the relationship between the oil circulation rate and the compressor frequency in accordance with the further embodiment of the present invention.
Figure 15B:
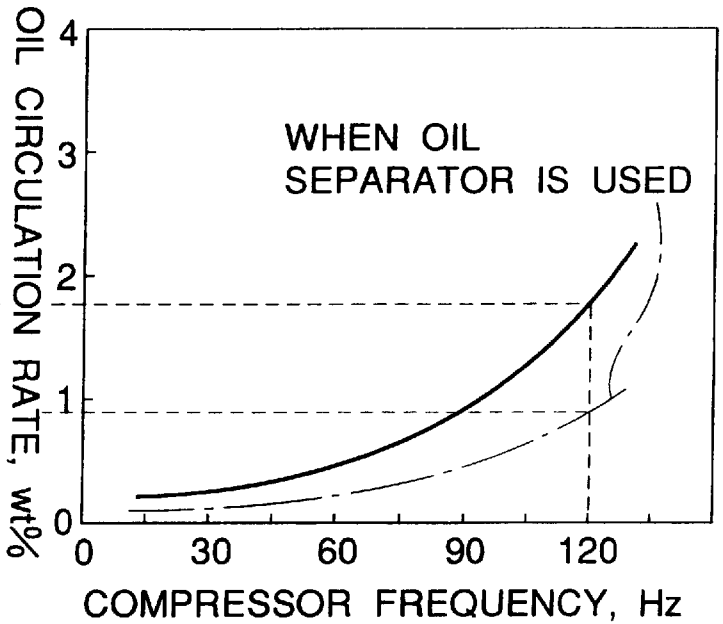

Referring now to FIGS. 14 and 15, a description will be given of a 13th embodiment of the present invention.

FIG. 14 is an example of the refrigerating and air-conditioning apparatus which is applied to an air conditioner, for example. Reference numeral 60 denotes an oil separator; 61, an oil separating net; and 62, a narrow pipe for returning oil. The refrigerant gas discharged from the compressor 1 enters the oil separator 60 from its top, passes through the oil separating net 61, further passes through a lead-out pipe inserted to the vicinity of the center of the oil separator, and is directed toward the condenser 52. At this time, the refrigerating machine oil which is included in the refrigerant gas adheres to the oil separating net 61, drops, and is accumulated at the bottom of the oil separator. The separated refrigerating machine oil 81 is returned to the low-pressure side compressor suction pipe by means of the narrow pipe 62 for returning oil. As shown in FIG. 15, since the oil circulating rate is reduced due to the effect of the oil separator 60, the allowable range for control of the intermediate pressure, which is effected to dissolve the refrigerating machine oil in the liquid refrigerant 13 inside the receiver 54, expands, and produces leeway. Accordingly, the refrigerating machine oil is easily dissolved in the liquid refrigerant 13 and is reliably returned to the compressor 1. In addition, subcooling can be controlled in correspondence with the condition of the load of the apparatus, thereby improving the efficiency and performance of the refrigeration and air-conditioning cycle apparatus.

In FIG. 14, electrically-operated expansion valves are used as the pressure reducing devices 31 and 32. To lower the temperature of the liquid refrigerant in the receiver, it suffices if the pre-stage valve 31 is operated in the closing direction and the post-stage valve 32 is operated in the opening direction, or if the number of revolutions of the condenser fan is increased. If a setting is to be provided to increase the temperature of the liquid refrigerant, it suffices if the amount of opening of the pre-stage valve 31 is changed in the opening direction and the amount of opening of the post-stage valve 32 is changed in the closing direction, or if the number of revolutions of the condenser fan is decreased.

If the conditions of the rate of solubility of the refrigerating machine oil in the liquid refrigerant has changed in the relationship between various kinds of refrigerants such as a single refrigerant or mixture HFC or HC such as R.410A and R.407C and various kinds of refrigerating machine oils such as alkylbenzene or mineral oil, if the oil circulation rate becomes higher than the rate of solubility due to a change or the like in the kind (reciprocating, rotary, and scroll) and structure of the compressor, adjustment is first made by changing the method of controlling the expansion valves and the condenser fan. However, if the oil circulation rate becomes higher than the rate of solubility of the refrigerating machine oil in the liquid refrigerant even after adoption of a heater, it suffices if an oil separator having a characteristic required for recovery is provided during the assembly of the refrigerant circuit. Depending on the kinds of refrigerant and refrigerating machine oil, however, an oil recovering means is selected in advance with respect to the oil circulation rate, and adjustment is made of the expansion valves and the like, as required. In order not to increase the kinds of oil separators, if the decline in the oil circulation rate does not reach a necessary range, a plurality of oil separators may be arranged in series.

The above-described process for determining the specifications may also be determined in advance by conducting calculations and examinations by the following procedure.

First, the kinds of refrigerant and refrigerating machine oil are first selected in the light of the specifications, operating conditions, circuit conditions and the like which are set in advance. Next, the temperature of the refrigerant liquid and the pressure of the refrigerant in the receiver are calculated under the respective conditions, an examination is made as to whether the rate of solubility of the refrigerating machine oil in the liquid refrigerant is greater or smaller than an estimated oil circulation rate, and specifications on the number of oil separators required, the presence or absence of a heater, and the like may be determined. These settings may be determined by a program in which data is inputted in advance.

In the selection of oil, there are various elements to be taken into consideration, including the solubility in the refrigerant, lubricating performance, electrical insulation, an anti-sludge property, stability against water, hydrogen, temperature, and life, low-temperature fluidity, an effect on the environment, and cost. By making adjustment in control and adding an oil separator in the assembling procedure as described above, the range of selection of the refrigerating machine oil expands, so that the use of refrigerating machine oil which excels in the aforementioned performances becomes possible. In addition, in the event that a change has occurred in the kind of refrigerant with respect to the apparatus being used for the reasons of an environmental measure or the like, even if the compatibility between a newly introduced refrigerant and the refrigerating machine oil is lost, or a problem arises in the return of oil, it becomes possible to cope with such a problem by changing control without replacing the oil.

In addition, in a case where a change is made in the course of time in the kind of the refrigerant in the refrigerant circuit in which the compressor, the condenser, the pressure reducing devices, the evaporator, and the liquid accumulating means capable of accumulating the refrigerant are connected by pipes, the rate in which the refrigerating machine oil is dissolved in the refrigerant also changes. Further, if, for example, the concentration of the refrigerant becomes high, the amount of oil flowing out from the compressor to the circuit also increases.

That is, since the oil circulation rate becomes large, the refrigerating machine oil ceases to be returned to the compressor and a problem occurs, it suffices if the details of control are changed by changing the settings of the temperature and pressure of the refrigerant in the liquid accumulating means as in the present invention, such that the refrigerating machine oil is dissolved in the liquid refrigerant within the liquid accumulating means. Incidentally, at the time of such a change of the kind of refrigerant, the rate of solubility can be easily known from the past data.

Meanwhile, if an experiment is conducted by using a model machine on the basis of new combinations of the refrigerant and the refrigerating machine oil, it is easily possible to estimate the extent to which the oil will come to flow in a large amount. Alternatively, control may be determined by performing operation and confirming that the amount of oil flowing out to the circuit is large, by checking the amount of oil in the compressor, and by making a determination. This problem differs from the case of a new installation in which case the specifications can be studied sufficiently in advance, and there are cases where a single refrigerant is to be changed to a plurality of kinds of refrigerant. This problem also arises due to the relationship between the refrigerant and the refrigerating machine oil having such a rate of solubility that will exceed the numerical levels of weak compatibility which has been described above. Since the present invention is capable of coping with any cases by providing control without replacing the oil, it is possible to cope with an environmental measure and the like simply and flexibly.

Although the oil separator is disposed in the vicinity of the discharge outlet of the compressor, the oil separator may be disposed inside the compressor depending on the structure of the compressor.

In this refrigerating and air-conditioning apparatus, since the efflux of the refrigerating machine oil inside the compressor to the condenser, the receiver, and the evaporator is suppressed, the allowable range of control expands which is effected to allow the refrigerating machine oil to dissolve in the liquid refrigerant inside the receiver, so that the refrigerating machine oil in the receiver is reliably returned to the compressor. In addition, since the refrigerating machine oil which is attached to the pipe walls of the condenser and the evaporator can be decreased, the heat exchange efficiency does not decline.

14th Embodiment

Figure 16:
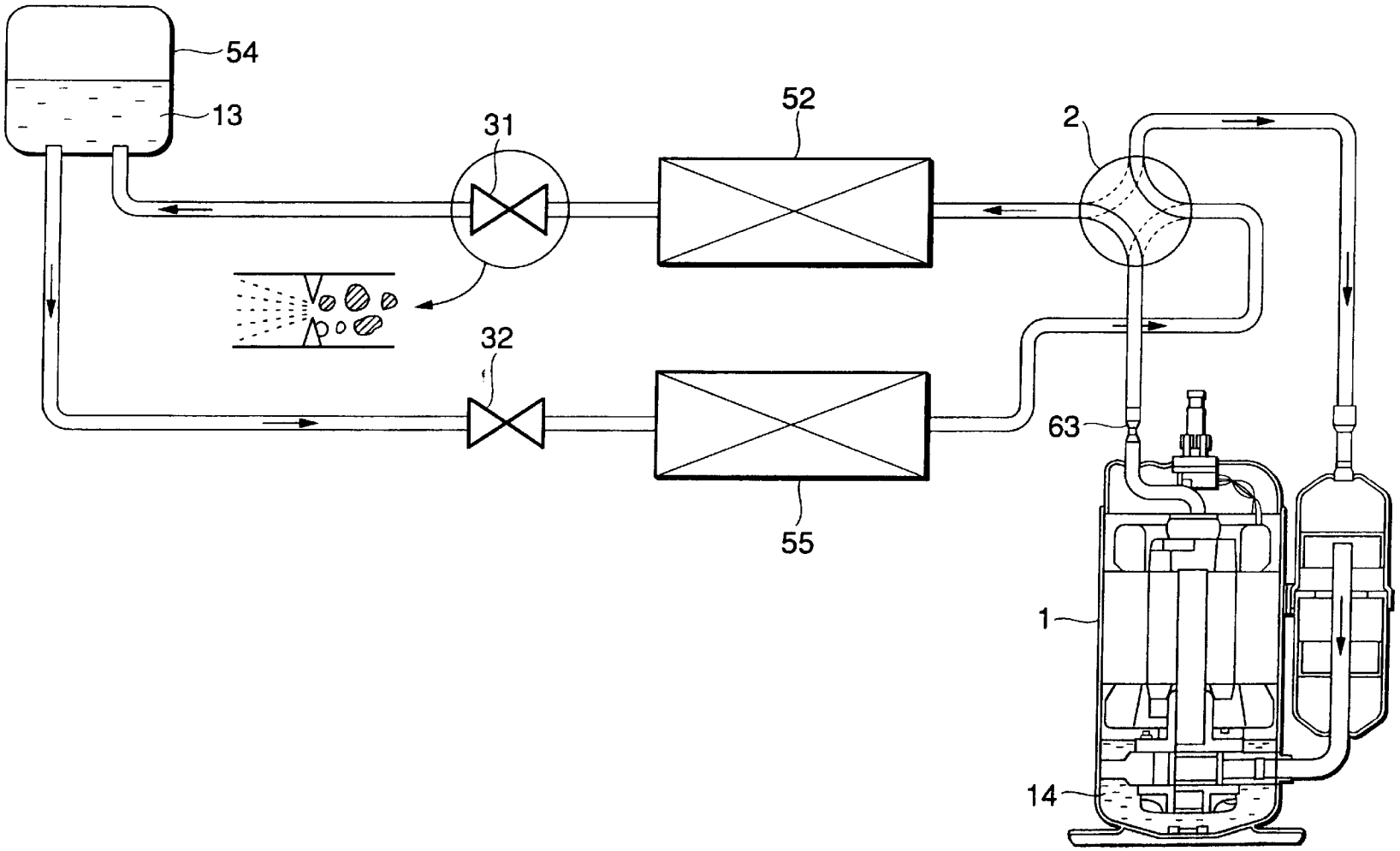
FIG. 16 is a schematic diagram of the refrigerating and air-conditioning apparatus illustrating a further embodiment of the present invention.

Referring now to FIG. 16, a description will be given of a 14th embodiment of the present invention. FIG. 16 is an example of the refrigerating and air-conditioning apparatus which is applied to an air conditioner, for example. Reference numeral 31 denotes the pre-stage pressure reducing device comprising an orifice. In a case where a large amount of refrigerating machine oil is transiently discharged from the compressor 1 such as during restarting after the "sleeping" of the refrigerant, the liquid refrigerant and a large amount of refrigerating machine oil which cannot be dissolved in the liquid refrigerant flow in the vicinity of the outlet of the condenser 2. However, when passing through the orifice section of the pre-stage pressure reducing device 31, the refrigerating machine oil which is nonsoluble in the pipe assumes a state of fine mist and flows into the receiver 54. For this reason, even if a refrigerating machine oil whose specific weight is smaller than that of the refrigerant is used, the refrigerating machine oil does not immediately form a separate layer inside the receiver 54 but assumes a state in which it is suspended in the liquid refrigerant, and the refrigerating machine oil also flows out with the flow of the liquid refrigerant. Consequently, the large amount of the refrigerating machine oil which flowed into the receiver 54 is returned quickly to the compressor without being detained there.

It should be noted that, in order to make the oil droplets finer, it suffices if the oil droplets are quickly passed through a narrow portion, and a structural component such as a sludge filter may be used instead.

15th Embodiment

Figure 17:
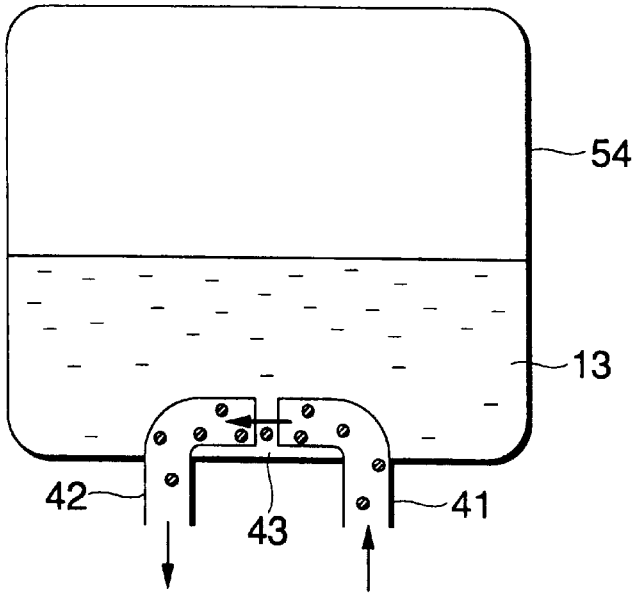
FIG. 17 is a diagram illustrating the structure of the receiver in accordance with the further embodiment of the present invention.
Figure 18:
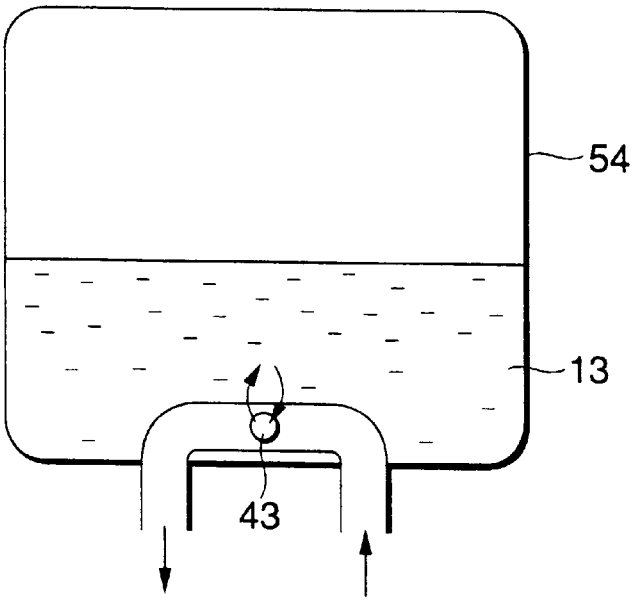
FIG. 18 is a diagram illustrating the structure of the receiver in accordance with the further embodiment of the present invention.

Referring now to FIGS. 16, 17, and 18, a description will be given of a 15th embodiment of the present invention.

FIGS. 17 and 18 show examples of the structure o the receiver 54 which is shown in FIG. 16 and is used in the present invention. Reference numeral 41 denotes a refrigerant inlet pipe for the refrigerant to flow into the receiver 54; 42, a refrigerant outlet pipe; and 43, an opening for communication between each pipe to the receiver. In a case where a large amount of refrigerating machine oil is transiently discharged from the compressor 1 such as during restarting after the "sleeping" of the refrigerant, the liquid refrigerant and a large amount of refrigerating machine oil which cannot be dissolved in the liquid refrigerant flow, pass through the pre-stage pressure reducing device 31, and flow into the receiver 54. However, since the inlet pipe 41 and the outlet pipe 42 are shaped in such a manner as to oppose each other as shown in FIG. 17, most of the refrigerating machine oil flows out without being detained in the receiver 54, and quickly returns to the compressor. In addition, in the example shown in FIG. 18, since the entry and exit of the liquid refrigerant between the pipe and the receiver 54 are effected through the communicating hole 43, the refrigerating machine oil flows through the pipe without entering the receiver 54, and quickly returns to the compressor. In a case where the refrigerating machine oil whose specific weight is greater than that of the liquid refrigerant is used, it suffices if the communicating hole 43 is provided in such a manner as to be oriented laterally or upwardly, while in a case where the refrigerating machine oil whose specific weight is smaller than that of the liquid refrigerant is used, it suffices if the communicating hole 43 is provided in such a manner as to be oriented laterally or downwardly.

The refrigerating and air-conditioning apparatus in accordance with the present invention is structured such that the inlet pipe opening and the outlet pipe opening are opposed to each other at the bottom of the receiver, and the influx of the refrigerating machine oil which is nonsoluble in the liquid refrigerant into the receiver is suppressed. Accordingly, even if a large amount of refrigerating machine oil is transiently discharged into the receiver, most of the refrigerating machine oil flows out without being detained in the receiver, and quickly returns to the compressor, by virtue of the configuration in which the inlet pipe and the outlet pipe are opposed to each other.

16th Embodiment

Figure 19:
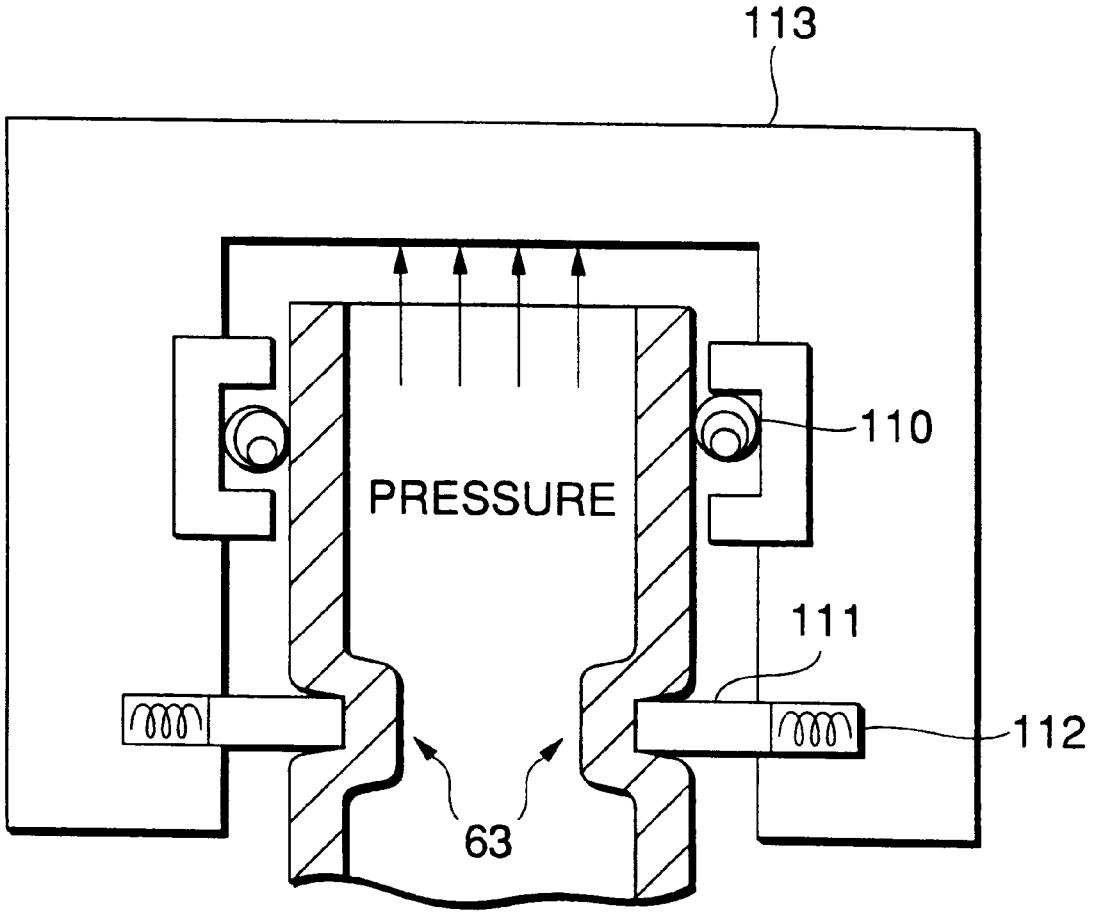
FIG. 19 is a partial explanatory diagram of the apparatus in accordance with a further embodiment of the present invention.
Figure 20:
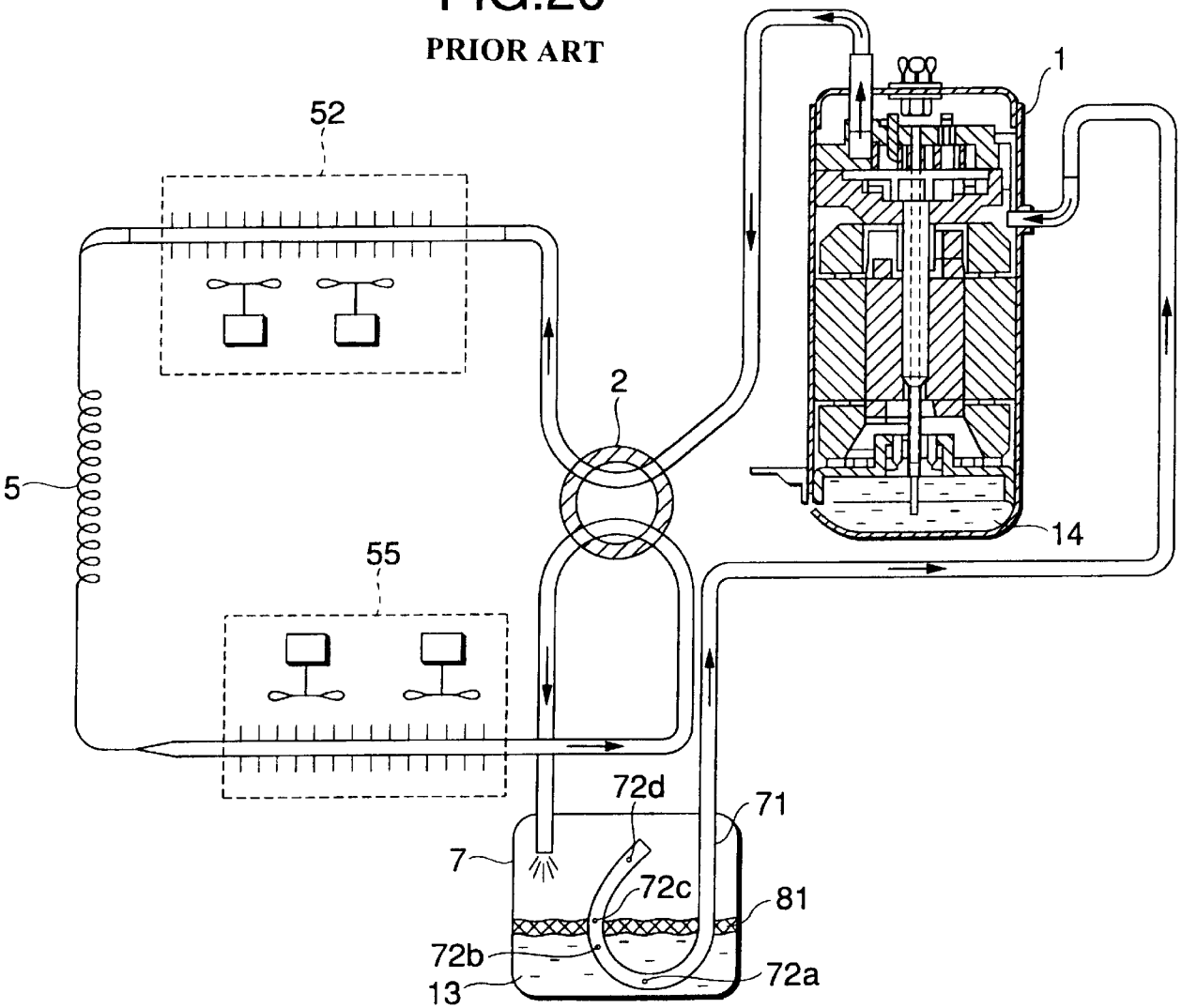
FIG.20 PRIOR ART
FIG. 20 is a schematic diagram of a conventional refrigeration and air-conditioning cycle apparatus.
Figure 21:
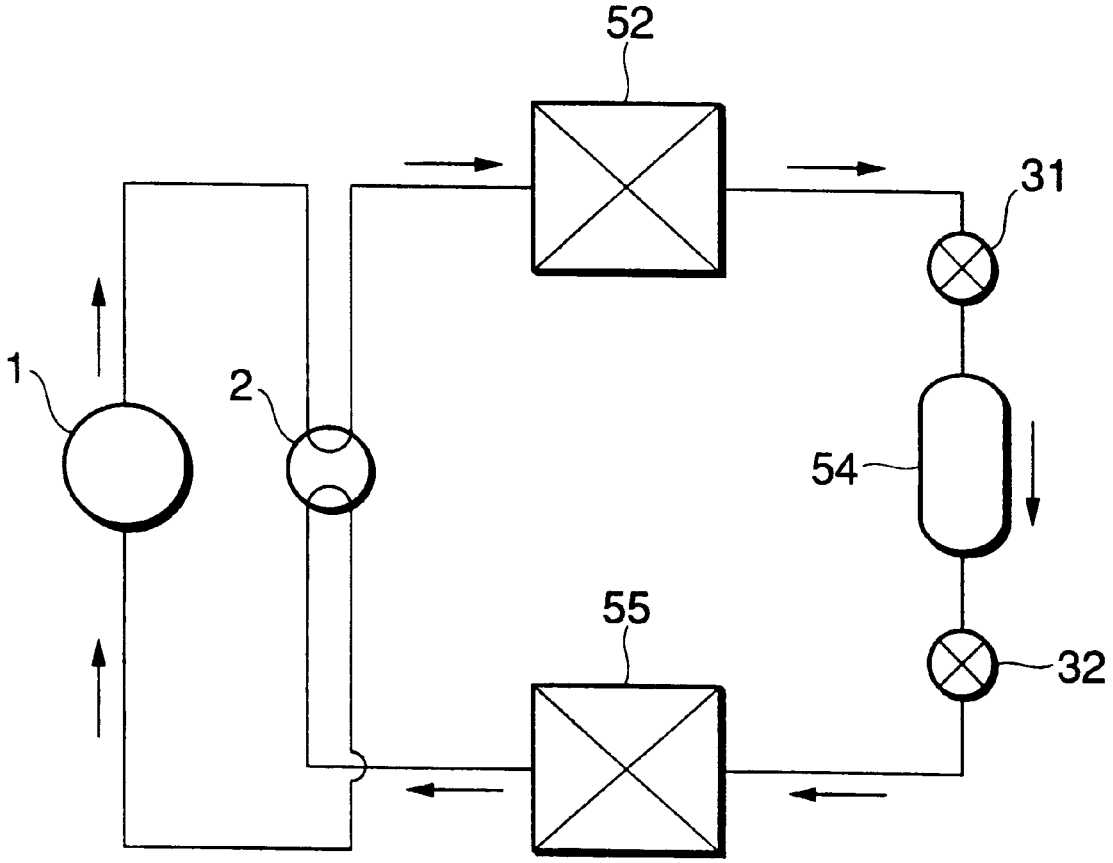
FIG.21 PRIOR ART
FIG. 21 is a schematic diagram of another conventional example of the refrigeration and air-conditioning cycle apparatus.

Referring now to FIGS. 16 and 19, a description will be given of a 16th embodiment of the present invention. The structure provided is such that the discharge pipe of the compressor 1 is provided with a reduced-diameter pipe portion 63 outside the hermetic container, and a system is adopted in which claws 111 of a jig 113 for closing the discharge pipe in an airtight test in the process of manufacturing the compressor are caught at the reduced-diameter pipe portion 13 by pressing the claws 111 by means of springs 112. In a case where a high-pressure refrigerant such as R.410A as an HFC-based refrigerant is used, although the airtight test is conventionally performed under the pressure of 28 kgf/cm$^2$G in the compressor using R.22, it has been necessary to perform the airtight test under a considerably high pressure of 45 kgf/cm$^2$G when R.410A is used. By virtue of the arrangement adopted in this embodiment, the jig is difficult to come off even if the high pressure is applied, so that the airtight test can be performed safely and reliably.

Conventionally, when the interior of the compressor is set at a high pressure, the jig closing the discharge pipe tends to come off due to the pressure difference, the conventionally used jig is arranged such that claws are pressed against the discharge pipe, and the jig is fixed by the frictional force.

On the other hand, in the present invention, indented portions are provided on the discharge pipe of the compressor as shown in FIG. 16. If the reduced-diameter pipe portion (necking) 63 is provided on the discharge pipe, the claws of the jig can be caught therein, and can be made more difficult to come off than in the conventional arrangement.

Consequently, the airtight test of the compressor can be performed safely and reliably.

In the foregoing description of the embodiments, the receiver 54 is disposed in an intermediate pressure portion, but the receiver 54 may be disposed at any position insofar as the oil can be recovered. In the final analysis, if the pressure and temperature of the liquid refrigerant in the receiver are set such that the rate of solubility of the refrigerating machine oil in the liquid refrigerant becomes higher than the oil circulation rate of the refrigerating machine oil which flows out from the compressor to the refrigerant circuit during operation, even if a large amount of oil flows out temporarily, the oil can be returned reliably. Incidentally, even if the suction muffler 101 is provided on the suction side of the compressor as shown in FIG. 11, and a noncompatible oil is adopted, the internal oil can be recovered reliably by a conventionally known recovering structure. Namely, in the present invention, if the oil is preferably allowed to flow after dissolving in the refrigerant on the upstream side of the circuit, it is possible to obtain a highly reliable apparatus in which clods of oil flow to, for instance, the indoor unit and the like of the air conditioner and the clogging at the capillary tubes and the like is prevented from occurring.

In addition, although a large-size refrigerating and air-conditioning apparatus is used as an object for the liquid accumulating portion, in the case of a small-scale circuit such as that of a refrigerator the liquid accumulating portion may naturally be used for a portion where the liquid refrigerant is detained such as at a dryer or a filter device which is connected to the pipe.

By virtue of the configurations of the above-described embodiments, since, for example, the range for control of subcooling which is effected in correspondence with the condition of the load of the apparatus can be expanded in accordance with the present invention, the efficiency and performance of the refrigerating and air-conditioning apparatus can be improved.

In addition, since the surplus refrigerant can be detained in correspondence with the condition of the load of the apparatus, and a large amount of liquid refrigerant is not returned to the compressor, the reliability of the compressor is improved. Moreover, the apparatus in accordance with the present invention is capable of coping with the reversing of the refrigeration cycle such as by the changeover of the four-way valve, has a simple structure, excels in cost performance, and does not cause a decline in the performance due to such as the clogging with dust.

Advantages of the Invention

As described above, in the refrigerant circulating apparatus in accordance with the first aspect of the invention, since the liquid accumulating container for allowing oil droplets to flow out in suspended form is connected between the condenser and the pressure reducing device, the refrigerating machine oil which flowed out from the compressor can be reliably returned to the compressor, and proper lubricating and sealing functions can be maintained for the compressing elements. Hence, it is possible to obtain an apparatus in which the reliability of the compressor is high. In addition, the structure is simple, productivity and cost performance are outstanding, and a decline in the performance due to the clogging with dust does not occur.

In the refrigerant circulating apparatus in accordance with the second aspect of the invention, since the structure provided is such that the refrigerant is accumulated on the flowing side where the surplus refrigerant occurs, and the liquid accumulating container allows the oil droplets to flow out in suspended form. Therefore, the refrigerating machine oil which flowed out from the compressor can be reliably returned to the compressor, and proper lubricating and sealing functions can be maintained for the compressing elements. Hence, it is possible to obtain an apparatus in which the reliability of the compressor is high. In addition, in a case where the flowing direction of the refrigerant is reverse, since the refrigerant is not accumulated in the container, the refrigerating machine oil is nether accumulated, so that the refrigerating machine oil can be returned to the compressor.

In the refrigerant circulating apparatus in accordance with the third aspect of the invention, since the liquid accumulating container is interposed between the pair of pressure reducing devices, the refrigerant can be accumulated irrespective of the flowing direction of the refrigerant, and since the container is disposed in a high-pressure liquid section, the refrigerating machine oil is dissolved in the refrigerant, and can be returned to the compressor without being detained in the liquid accumulating container.

In the refrigerant circulating apparatus in accordance with the fourth aspect of the invention, since the refrigerant from the inlet at a lower portion of the liquid accumulating container flows toward the lower surface of the oil layer, and the oil layer is agitated by the flow of the refrigerant, the dissolution of the refrigerating machine oil in the refrigerant is provided. Further, since the oil flows out from the outlet at the lower portion, the oil can be returned to the compressor with a simple arrangement, and the reliability of the compressor can be enhanced.

In the refrigerant circulating apparatus in accordance with the fifth aspect of the invention, since the refrigerant in the container is agitated by imparting a change to the state of the refrigerant which flowed in from the container inlet, the mixing of the interface between the refrigerant and the refrigerating machine oil is promoted, thereby promoting the dissolution of the refrigerating machine oil in the refrigerant. Consequently, the return of the refrigerating machine oil detained in the container to the compressor is promoted, and the reliability of the compressor can be enhanced.

In the refrigerant circulating apparatus in accordance with the sixth aspect of the invention, since the liquid accumulating container is interposed between the pair of pressure reducing devices, the refrigerant can be accumulated irrespective of the flowing direction of the refrigerant, and since the container is disposed in a high-pressure liquid section, the refrigerating machine oil is dissolved in the refrigerant, and can be returned to the compressor without being detained in the liquid accumulating container.

Since the pressure reducing device on the low-pressure side is controlled, it is possible to obtain required superheating, and the degree of superheating in the suction by the compressor can be controlled, thereby making it possible to obtain an apparatus having excellent operating efficiency.

In addition, since the amount of refrigerant accumulated in the container and the refrigerant temperature are controlled, the dissolution of the refrigerating machine oil in the refrigerant can be promoted.

Since the pressure reducing device on the high-pressure side is controlled, it is possible to obtain required subcooling, thereby making it possible to obtain an apparatus having excellent operating efficiency. In addition, since the amount of refrigerant accumulated in the container and the refrigerant temperature are controlled, the dissolution of the refrigerating machine oil in the refrigerant can be promoted.

Further, since the pressure reducing devices on the low-pressure side and the high-pressure side are controlled in an interlocking manner, the degree of superheating and the degree of subcooling can be simultaneously controlled to appropriate values. Hence, the apparatus is able to fully demonstrate its capabilities, and an apparatus having excellent operating efficiency can be obtained.

In the refrigerant circulating apparatus in accordance with the seventh aspect of the invention, since the pressure reducing devices are controlled such that the liquid refrigerant in the container becomes temporarily empty, even if a large amount of refrigerating machine oil is detained in the container, the refrigerating machine oil is allowed to flow out from the container reliably, thereby making it possible to reliably return the refrigerating machine oil.

In the refrigerant circulating apparatus in accordance with the eighth aspect of the invention, since a control valve which is controllable is used as the pressure reducing device, and the control valve is controlled with the lapse of a predetermined time after starting, the refrigerant which is temporarily detained after starting can be discharged, and it is possible to cope with a malfunction such as the "sleeping" of the refrigerant.

In the refrigerant circulating apparatus in accordance with the ninth aspect of the invention, since the refrigerating machine oil can be reliably returned to the compressor without detaining a large amount of refrigerating machine oil in the liquid accumulating container, proper lubricating and sealing functions can be maintained for the compressing elements of the compressor, and a highly reliable product can be obtained.

In the refrigerant circulating apparatus in accordance with the 10th aspect of the invention, it is possible to obtain an efficient apparatus which does not cause a decline in the efficiency of the heat exchanger and which is able to expand the control range, thereby making it possible to obtain an efficient apparatus.

In the refrigerant circulating apparatus in accordance with the 11th aspect of the invention, since the oil is caused to dissolve by making the oil droplets finer, the oil can be recovered reliably.

In the refrigerant circulating apparatus in accordance with the 12th aspect of the invention, since the efflux of the refrigerating machine oil used in lubricating and sealing the compressor to the condenser, the liquid accumulating container, and the evaporator is suppressed, the refrigerating machine oil which flowed out can be reliably returned to the compressor, and the heat exchange efficiency of the condenser and the evaporator is prevented from declining.

In the refrigerant circulating apparatus in accordance with the 13th aspect of the invention, even in a case where a large amount of refrigerating machine oil is transiently discharged from the compressor, the refrigerating machine oil can be reliably returned to the compressor without being detained in the receiver.

In the refrigerant circulating apparatus in accordance with the 14th aspect of the invention, in the manufacture of the compressor, an airtight test can be performed safely and reliably.

In the refrigerant circulating apparatus in accordance with the 15th aspect of the invention, even if a refrigerating machine oil which has nonsolubility or weak solubility in the refrigerant under predetermined conditions is used, the refrigerating machine oil can be reliably returned, so that it is possible to obtain an apparatus i which the compressor is highly reliable and for which maintenance is facilitated.

In the method of assembling a refrigerant circuit in accordance with the 16th aspect of the invention, since the temperature or the pressure of the refrigerant in the liquid accumulating means is set such that the rate of solubility of the refrigerating machine oil in the liquid refrigerant inside the liquid accumulating means becomes approximately equivalent to or higher than the oil circulation rate of the refrigerating machine oil which flows out from the compressor to the refrigerant circuit during operation, it is possible to simply assemble the refrigerant circuit which facilitates the recovery of oil.

In the refrigerant circulating apparatus in accordance with the 17th aspect of the invention, as a measure against the ozone-layer destroying Freon in air conditioners, refrigerators, and the like, it is possible to provide a measure by performing the operation of replacing only the refrigerant and by changing only the settings of the controller without changing the refrigerating machine oil. Thus, since processing can be provided simply, it is possible to provide an effective measure for the environmental protection.

What is claimed is:

1. A refrigerant circulating apparatus having a refrigerant circuit in which a compressor, a condenser, a pressure reducing device, and an evaporator are consecutively connected by refrigerant pipes, said refrigerant circulating apparatus comprising:

a liquid accumulating container connected between said condenser and said pressure reducing device for allowing oil droplets to flow out in suspended form, having refrigerating machine oil which exhibits nonsolubility or very weak solubility in terms of a rate by weight of solubility of the refrigerating machine oil in a liquid refrigerant under conditions of condensing pressure and condensing temperature and which exhibits nonsolubility or very weak solubility in terms of a rate by weight of solubility of the refrigerating machine oil in the liquid refrigerant under conditions of evaporating pressure and evaporating temperature, and which has smaller specific gravity than the refrigerant.

2. A refrigerant circulating apparatus according to claim 1, further comprising:

means for changing over a flowing direction of the refrigerant, said liquid accumulating container being constructed for allowing the oil droplets to flow out in suspended form being connected between said condenser and said pressure reducing device on a flowing side where the liquid refrigerant becomes surplus.

3. A refrigerant circulating apparatus having a refrigerant circuit in which a compressor, means for changing over a flowing direction of a refrigerant, a condenser, a pair of pressure reducing devices, and an evaporator are consecutively connected by refrigerant pipes, said refrigerant circulating apparatus comprising:

a liquid accumulating container interposed between said pressure reducing devices, by using a refrigerating machine oil which exhibits nonsolubility or very weak solubility in terms of a rate by weight of solubility of the refrigerating machine oil in a liquid refrigerant under the conditions of condensing pressure and condensing temperature and which exhibits nonsolubility or very weak solubility in terms of a rate by weight of solubility of the refrigerating machine oil in the liquid refrigerant under the conditions of evaporating pressure and evaporating temperature.

4. A refrigerant circulating apparatus according to claim 3, wherein refrigerant pipes at an inlet and an outlet of the refrigerant into and from said liquid accumulating container are inserted into said container from a lower portion thereof, and the refrigerant inside said liquid accumulating container is allowed to flow from below to above and is agitated.

5. A refrigerant circulating apparatus according to claim 3 or 4, wherein the refrigerant inside said liquid accumulating container is agitated by changing a state of a phase of the refrigerant or a state of pressure thereof at a position where the refrigerant flows in from an inlet pipe of said liquid accumulating container for accumulating surplus refrigerant.

6. A refrigerant circulating apparatus according to claim 3 or 4, further comprising:

at least one of subcooling detecting means for detecting a subcooling characteristic value corresponding to a degree of subcooling of the refrigerant at an outlet of said condenser and superheating detecting means for detecting a superheating characteristic value corresponding to a degree of superheating of the refrigerant sucked into said compressor;

calculating means for calculating a deviation with a targeted value corresponding with at least one of a result of detection by said superheating detecting means and a result of detection by said subcooling detecting means; and controlling means for controlling a control valve of at least one of said pressure reducing devices on a high-pressure side and a low-pressure side on the basis of the result of calculation by said calculating means.

7. A refrigerant circulating apparatus according to claim 3 or 4, wherein a control valve which is controllable is used as said pressure reducing device, and an area of an opening in said control valve is controlled such that the liquid refrigerant in said container becomes temporarily empty.

8. A refrigerant circulating apparatus according to claim 7, wherein said control valve which is controllable is used as said pressure reducing device, and said control valve is controlled with the lapse of a predetermined time after starting.

9. A refrigerant circulating apparatus comprising:

a refrigerant circuit in which a compressor, a condenser, a pair of pressure reducing devices, and an evaporator are consecutively connected by refrigerant pipes;

a liquid accumulating container provided in said refrigerant circuit for accumulating a refrigerant and a refrigerating machine oil which exhibits nonsolubility or very weak solubility in a liquid refrigerant under conditions of condensing pressure and condensing temperature and under conditions of evaporating pressure and evaporating temperature with respect to the refrigerant which circulates in said refrigerant circuit; and oil-solubility-rate setting means for setting at least one of the temperature and pressure of the refrigerant in said liquid accumulating container such that a rate of solubility of the refrigerating machine oil in the liquid refrigerant inside said liquid accumulating container becomes approximately equivalent to or higher than an oil circulation rate of the refrigerating machine oil which flows out from said compressor to said refrigerant circuit during operation.

10. A refrigerant circulating apparatus according to claim 9, wherein pressure reducing devices are respectively disposed before and after said liquid accumulating container disposed in said refrigerant circuit for accumulating the refrigerant, and the temperature and pressure of the refrigerant in said liquid accumulating container are set by said pressure reducing devices such that the rate of solubility of the refrigerating machine oil in the liquid refrigerant inside said liquid accumulating container becomes approximately equivalent to or higher than the oil circulation rate of the refrigerating machine oil which flows out from said compressor to said refrigerant circuit during operation.

11. A refrigerant circulating apparatus according to claim 9, wherein means for making oil droplets finer is used as at least a pre-stage pressure reducing device of said pressure reducing devices disposed respectively before and after said liquid accumulating container.

12. A refrigerant circulating apparatus comprising:

a refrigerant circuit in which a compressor, a condenser, a first pressure reducing device, a second pressure reducing device, and an evaporator are consecutively connected by refrigerant pipes;

a liquid accumulating container provided in said refrigerant circuit between said first and second pressure reducing devices for accumulating a refrigerant and a refrigerating machine oil which exhibits nonsolubility or very weak solubility in a liquid refrigerant under conditions of condensing pressure and condensing temperature and under conditions of evaporating pressure and evaporating temperature with respect to the refrigerant which circulates in said refrigerant circuit; and oil recovering means disposed in an interior of said compressor or on a discharge side of said compressor for lowering an oil circulation rate such that the oil circulation rate of the refrigerating machine oil which flows out from said compressor to said refrigerant circuit during operation becomes approximately equivalent to or lower than a rate at which the liquid refrigerant inside said liquid accumulating container dissolves the refrigerating machine oil.

13. A refrigerant circulating apparatus according to claim 4, 9, 10, 11, or 12, wherein an inlet pipe for the refrigerant to flow into said liquid accumulating container from said refrigerant circuit and an outlet pipe for the refrigerant to flow out from said liquid accumulating container to said refrigerant circuit are arranged with their respective pipe openings disposed in a lower portion of said liquid accumulating container, and are arranged to allow the refrigerant to flow directly from said inlet pipe into said outlet pipe.

14. A refrigerant circulating apparatus according to claim 3, 4, 9, or 12, further comprising:

an engaging portion disposed on a discharge-side pipe of said compressor and having a changed outside diameter of the pipe.

15. A refrigerant circulating apparatus according to claim 1, 3, 4, 9, or 12, wherein the refrigerating machine oil has nonsolubility or very weak solubility with respect to the refrigerant, with its rate by weight of solubility in the liquid refrigerant under the conditions of condensing pressure and condensing temperature being 0.5–7 wt %, and its rate by weight of solubility in the liquid refrigerant under the conditions of evaporating pressure and evaporating temperature being 0–2.0 wt %.

16. A method of assembling a refrigerant circuit, comprising the steps of:

providing in said refrigerant circuit liquid accumulating means for accumulating. a refrigerant circulating in a refrigerant circuit in which a compressor, a condenser, a pressure reducing device, and an evaporator are consecutively connected by refrigerant pipes;

sealing in said refrigerant circuit a refrigerating machine oil which exhibits nonsolubility or very weak solubility in a liquid refrigerant under conditions of condensing pressure and condensing temperature and under conditions of evaporating pressure and evaporating temperature; and setting at least one of the temperature and pressure of the refrigerant in said liquid accumulating means such that a rate of solubility of the refrigerating machine oil in the liquid refrigerant inside said liquid accumulating means becomes approximately equivalent to or higher than an oil circulation rate of the refrigerating machine oil which flows out from said compressor to said refrigerant circuit during operation.

17. A method of assembling a refrigerant circuit, comprising the steps of:

changing a kind of refrigerant to be circulated in a refrigerant circuit in which a compressor having a refrigerating machine oil, a condenser, a pressure reducing device, an evaporator, and liquid accumulating means for accumulating a refrigerant are consecutively connected by refrigerant pipes from a sealed refrigerant to another refrigerant;

continuing to seal in the a refrigerating machine oil sealed in said compressor even if the kind of refrigerant is changed; and setting at least one of the temperature and pressure of the refrigerant in said liquid accumulating means such that a rate of solubility of the refrigerating machine oil in the changed refrigerant becomes approximately equivalent to or higher than an oil circulation rate of the refrigerating machine oil which flows out from said compressor to said refrigerant circuit during operation in a case where the rate of solubility of the refrigerating machine oil is lower than the oil circulation rate.

18. A refrigerant circulating apparatus according to claim 5, further comprising:

at least one of subcooling detecting means for detecting a subcooling characteristic value corresponding to a degree of subcooling of the refrigerant at an outlet of said condenser and superheating detecting means for detecting a superheating characteristic value corresponding to a degree of superheating of the refrigerant sucked into said compressor;

calculating means for calculating a deviation with a targeted value corresponding with at least one of a result of detection by said superheating detecting means and a result of detection by said subcooling detecting means; and controlling means for controlling a control valve of at least one of said pressure reducing devices on a high-pressure side and a low-pressure side on the basis of the result of calculation by said calculating means.

19. A refrigerant circulating apparatus according to claim 5, wherein a control valve which is controllable is used as said pressure reducing device, and an area of an opening in said control valve is controlled such that the liquid refrigerant in said container becomes temporarily empty.

20. A refrigerant circulating apparatus according to claim 6, wherein a control valve which is controllable is used as said pressure reducing device, and an area of an opening in said control valve is controlled such that the liquid refrigerant in said container becomes temporarily empty.

21. A refrigerant circulating apparatus according to claim 19, wherein said control valve which is controllable is used as said pressure reducing device, and said control valve is controlled with the lapse of a predetermined time after starting.

22. A refrigerant circulating apparatus according to claim 20, wherein said control valve which is controllable is used as said pressure reducing device, and said control valve is controlled with the lapse of a predetermined time after starting.

23. A refrigerant circulating apparatus according to claim 5, wherein an inlet pipe for the refrigerant to flow into said liquid accumulating container from said refrigerant circuit and an outlet pipe for the refrigerant to flow out from said liquid accumulating container to said refrigerant circuit are arranged with their respective pipe openings disposed in a lower portion of said liquid accumulating container, and are arranged to allow the refrigerant to flow directly from said inlet pipe into said outlet pipe.

24. A refrigerant circulating apparatus according to claim 5, further comprising:

an engaging portion disposed on a discharge-side pipe of said compressor and having a changed outside diameter of the pipe.

25. A refrigerant circulating apparatus according to claim 5, wherein the refrigerating machine oil has nonsolubility or very weak solubility with respect to the refrigerant, with its rate by weight of solubility in the liquid refrigerant under the conditions of condensing pressure and condensing temperature being 0.5–7 wt %, and its rate by weight of solubility in the liquid refrigerant under the conditions of evaporating pressure and evaporating temperature being 0–2.0 wt %.

* * * * *